US007003237B2

(12) United States Patent
Miyamoto et al.

(10) Patent No.: US 7,003,237 B2
(45) Date of Patent: Feb. 21, 2006

(54) IMAGE FORMATION SYSTEM, METHOD FOR DETERMINING IMAGE FORMATION CONDITION AND STORAGE MEDIUM STORING PROGRAM THEREFOR

(75) Inventors: Yoko Miyamoto, Ebina (JP); Takashi Kawabata, Ebina (JP); Keiji Yamamoto, Ebina (JP); Satoru Torimaru, Ebina (JP); Masaaki Takahashi, Ebina (JP); Katsunori Kikuchihara, Ebina (JP); Kiyotoshi Kaneyama, Ebina (JP); Satoshi Matsuzaka, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 75 days.

(21) Appl. No.: 10/682,073

(22) Filed: Oct. 10, 2003

(65) Prior Publication Data

US 2004/0184830 A1 Sep. 23, 2004

(30) Foreign Application Priority Data

Mar. 19, 2003 (JP) ..... 2003-074940

(51) Int. Cl.
*G03G 15/16* (2006.01)

(52) U.S. Cl. ..... 399/66; 399/3.2

(58) Field of Classification Search ..... 399/9, 399/11, 14, 15, 46, 49, 50–55, 66, 67, 69, 399/81–83, 85, 3.2
See application file for complete search history.

(56) References Cited

U.S. PATENT DOCUMENTS 5,839,013 A * 11/1998 Murasawa et al. ..... 399/15

FOREIGN PATENT DOCUMENTS

JP 11-212315 8/1999

* cited by examiner

*Primary Examiner*—Hoang Ngo
(74) *Attorney, Agent, or Firm*—Morgan Lewis & Bockius LLP

(57) ABSTRACT

Image formation condition is available, which hardly causes imperfections of the image quality. A full-color image formation system selects plural secondary transfer conditions in a secondary transfer unit within a specific range, forms test charts according to each of the secondary transfer conditions selected, and prints them out. A user checks by viewing the test charts printed on each recording sheet, and selects a page number of the sheet where the user evaluated an image quality as the best; and the image formation system sets the secondary transfer condition for the sheet as a standard secondary transfer condition thereafter.

17 Claims, 11 Drawing Sheets

91
ENVIRONMENT DETECTION UNIT
92
SHEET TYPE DETECTION UNIT
93
SYSTEM RESISTANCE DETECTION UNIT
84
MACHINE DATA STORAGE UNIT
40
85
APPLIED VOLTAGE CONTROL UNIT
82
PARAMETER SETTING UNIT
86
U/I CONTROL UNIT
95
DISPLAY/INPUT UNIT
83
PARAMETER STORAGE UNIT
81
MACHINE CONTROL UNIT
94
POWER SUPPLY UNIT

PK 93.3% : 3 COLOR 93.3% ( YELLOW 238 & MAGENTA 238 & CYAN 238 )

IMAGE FORMATION SYSTEM, METHOD FOR DETERMINING IMAGE FORMATION CONDITION AND STORAGE MEDIUM STORING PROGRAM THEREFOR

BACKGROUND OF THE INVENTION

1. Field of the Invention

The present invention relates to an image formation system such as an electro-photographic copying machine, laser printer, and the like, specifically to the image formation system suitable for forming images of a high image quality.

2. Description of the Related Art

In recent years, in the image formation system such as a printer, copying machine, facsimile, and the like, has been proposed the so-called full-color tandem machine, with a view to forming color images at a high speed and in a high image quality. Here, a system can be cited as a typical one of this tandem machine, in which: four image formation units of yellow (Y), magenta (M), cyan (C), and black (B) are arranged in cascade; the toner images of the four colors, yellow, magenta, cyan, and black that are sequentially formed by these image formation units are primarily transferred onto an intermediate transfer belt as an intermediate transfer member, thereafter the toner images are secondarily transferred all at once onto a sheet from the intermediate transfer belt; and the toner images formed on this sheet are fixed, whereby a full-color or monochromatic image is formed.

In this type of the image formation system, the setting of various image formation conditions is carried out to form satisfactory images on a sheet. Conventionally, a method of setting the primary transfer condition being one of the image formation conditions has be proposed, which includes: forming test patches on the intermediate transfer belt, while varying the strength of the primary transfer field in each image formation unit; and setting the optimum strength of the primary transfer field on the basis of the detection results of the patched toner images by a density sensor located to face to the intermediate transfer belt (refer to Patent Reference 1).

[Patent Reference 1]

Japanese Published Unexamined Patent Application No. Hei 11-212315.

However, the density sensor only detects the image density of a partial region along the conveyance direction of the intermediate transfer belt. Accordingly, it has been difficult to detect the imperfections of the image quality that are created on the edges of the sheet. For example, it is possible to prevent a smear from emerging on the rear part of the images on the sheet, by setting the strength of the transfer field slightly lower than the normal setting value. However, if the smear is not present in the region to be detected by the density sensor, the strength of the transfer field will be set to the normal setting value, accordingly it is impossible to prevent imperfections of the image quality from occurring.

SUMMARY OF THE INVENTION

The present invention has been made in view of the above technical problems, and provides an image formation condition whereby imperfections of the image quality and so forth are unlikely to be created.

The invention further provides an image formation condition according to the type of a recording material or the preference of a user.

The invention solves the above technical problems by the method of: setting plural image formation conditions, forming images practically on recording materials by the set plural image formation conditions, con fining by viewing the images formed on the recording materials, and selecting a satisfactory image formation condition among the plural image formation conditions.

According to one aspect of the invention, the image formation system includes: an image formation condition setting part that sets plural image formation conditions within a specific range; an image formation part that forms images on recording materials on the basis of the plural image formation conditions set by the image formation condition setting part; and a selection part that selects a specific image formation condition, on the basis of plural images with different image formation conditions, which are formed on the recording materials by the image formation part.

Here, the image formation system may be designed such that the image formation part includes a primary transfer mechanism that primarily transfers toner images formed on an image holding member onto an intermediate transfer member, and a secondary transfer mechanism that secondarily transfers the toner images transferred onto the intermediate transfer member, onto the recording materials, and the image formation condition setting part sets plural transfer conditions in the primary transfer mechanism or the secondary transfer mechanism as the image formation conditions. The image formation part includes, in addition to the first secondary transfer mechanism and secondary transfer mechanism, all the other mechanisms used for image formation such as a fixing mechanism and a development mechanism.

The image formation system may further include a setting range designation part that designates a setting range of the image formation condition by the image formation condition setting part. The image formation system may further include a basic condition determining part that determines a basic condition of the image formation condition on the basis of the characteristics of the recording material, in which the image formation condition setting part sets plural image formation conditions to include the basic condition determined by the basic condition determining part. Also, in the image formation system, the selection part may include an acceptance unit that accepts a selection instruction from a user.

According to another aspect of the invention, the image formation system includes an image forming part that forms images on recording materials, and a control parameter modification part that modifies control parameters to be used on an image forming process of the image forming part. In this case, each time the control parameter modification part modifies the control parameters, the image forming part sequentially forms test images on the recording materials on the basis of the modified control parameters.

Here, in the image formation system, the control parameter modification part may modify the control parameters step by step. The image formation system may further include an image selection part that selects a type of the test images. Further, the image forming part may include a fixing member that heats and presses images to fix them on the recording materials, and may pass a dummy recording material through the fixing member before forming the test images on the recording materials. Also, the control parameter modification part may modify the control parameters between the recording material and a next recording material, and/or inside a non-image formation area of the test image.

According to another aspect of the invention, the method of determining an image formation condition for forming images on recording materials includes a first step of setting plural image formation conditions, a second step of sequentially forming images on recording materials on the basis of the plural image formation conditions selected, and a third step of selecting a final image formation condition on the basis of plural images with different image formation conditions, which are formed on the recording materials.

Here, in the method of determining an image formation condition, the first step may select a basic image formation condition on the basis of a type of the recording material, and may select the plural image formation conditions to include the basic image formation condition. Further, the first step may set a selection range of the plural image formation conditions, before selecting the plural image formation conditions.

Further, the invention can be understood as the invention of a storage medium storing a program that implements the functions of the steps in the above method of determining an image formation condition.

The programs to be executed by a computer are stored, for example, in a storage medium in which the computer has stored to be readable. For example, a CD-ROM and such media meet the above storage medium, and a CD-ROM reader in the computer reads the programs. Conceivably, the programs thus read are stored, for example, in various memories such as a hard disk and so forth in the computer, and are executed accordingly. It is also conceivable that the programs are provided to an image formation system or a PC by, for example, a program transmission device through a network. Such a program transmission device is only needed to contain a memory to store the programs and a program transmission part to provide the programs through a network.

BRIEF DESCRIPTION OF THE DRAWINGS

Preferred embodiments of the present invention will be described in detail based on the followings, wherein.

DETAILED DESCRIPTION OF THE PREFERRED EMBODIMENTS

The preferred embodiments will now be described with reference to the accompanying drawings.

Figure 1:
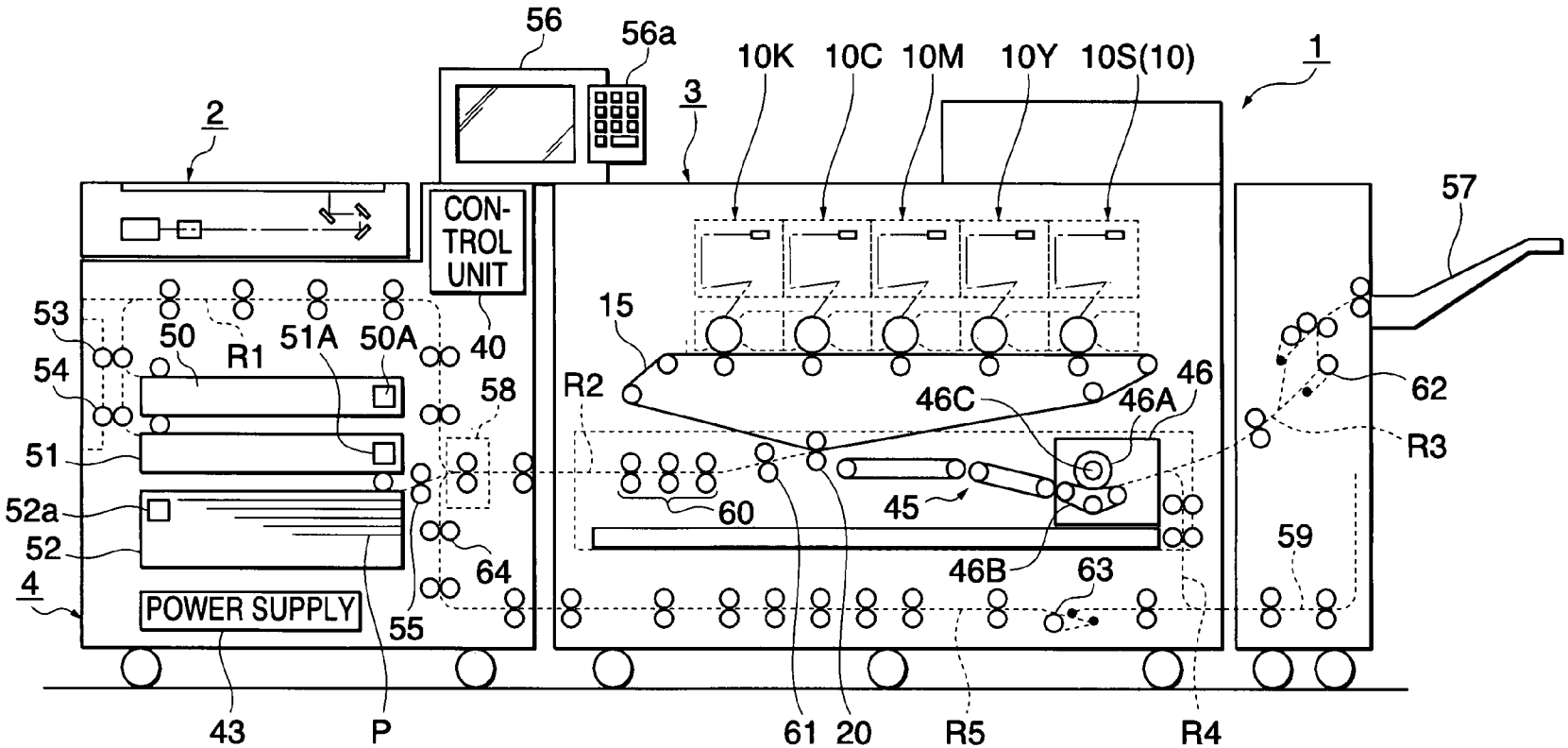
FIG. 1 is a schematic diagram showing the whole construction of a full-color image formation system relating to the embodiment.
Figure 2:
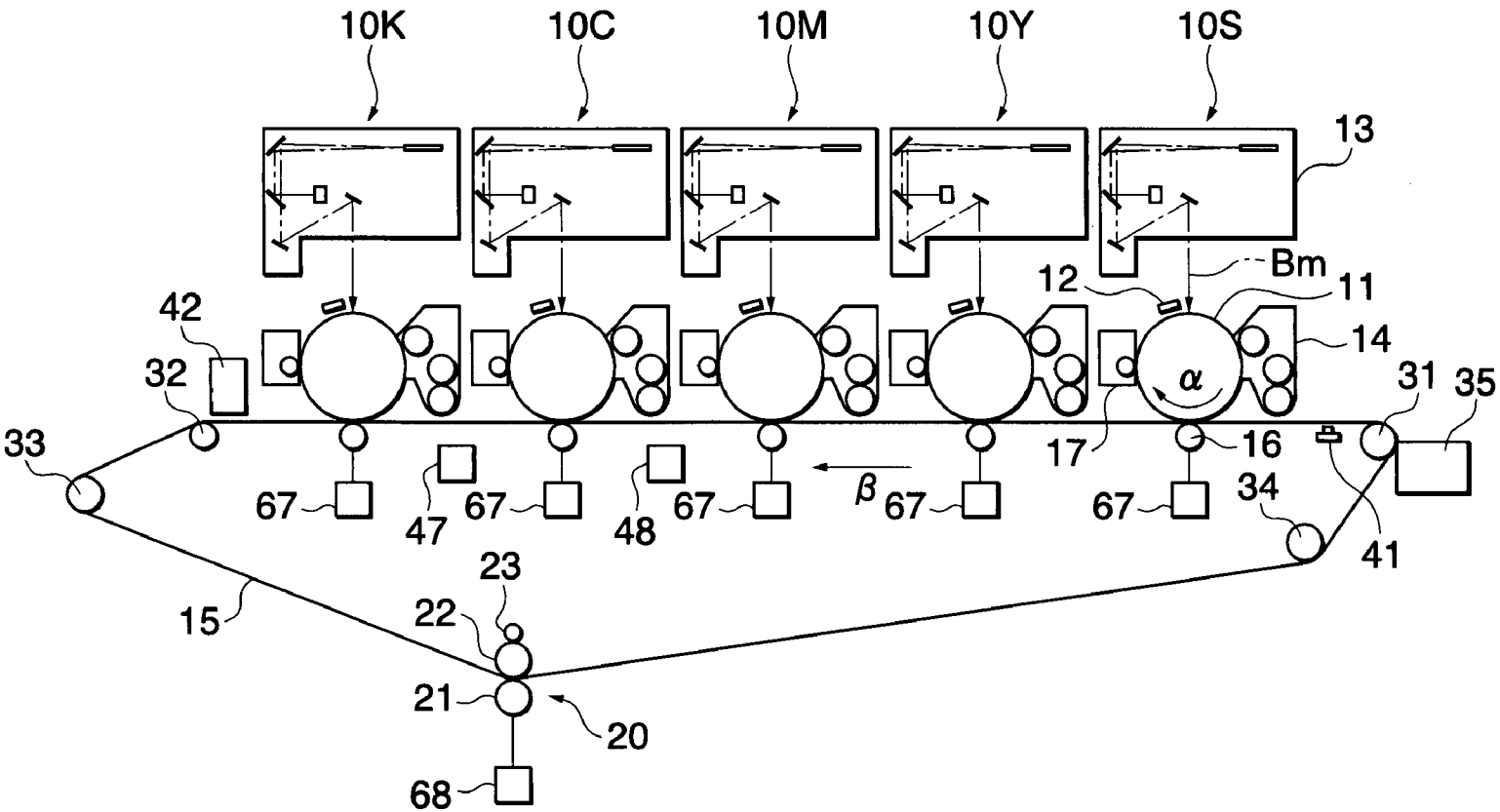
FIG. 2 is a drawing illustrating the major part of the full-color image formation system relating to the embodiment.

FIG. 1 is a schematic diagram showing the whole construction of a full-color image formation system 1 relating to one embodiment. FIG. 2 is an enlarged drawing of the major part of FIG. 1. The full-color image formation system 1 is an image formation system of the so-called tandem type, the so-called intermediate transfer system, which includes as the main constituents an image reader 2 that reads images of an original copy, an image formation unit 3 that forms the images on a sheet, a sheet feed unit 4 that feeds the sheet as a recording material into the image formation unit 3, etc.

In this embodiment, the image reader 2 is to read the images of an original copy set on a transparent platen for the copy, which includes an optical scanning system including, for example, a lamp, mirror, and carriage, and so forth, a lens system that forms optical images scanned through the optical scanning system, and an image read sensor such as a CCD that receives the optical images formed by the lens system to transform the received images into an electric signal.

The image formation unit 3 functions as an image formation part or an image forming part, which includes a plurality of image formation units 10 (10S, 10Y, 10M, 10C, 10K) that form toner images of each color components by means of the electro-photographic system, an intermediate transfer belt 15 that allows the toner images of each colors formed by each of the image formation units 10 to be sequentially transferred (primary transfer) and retained thereon, a secondary transfer unit 20 that transfers in a lump the superimposed toner images transferred on the intermediate transfer belt 15 onto a sheet P being a recording material (transfer material), and a fixing unit 46 that fixes the secondary transferred images on the sheet P. In connection with the above units, the image formation system 1 possesses a control unit 40 that controls the operations of each device (each unit), and functions as a setting part for image formation conditions or a control parameter modification part.

This image formation system 1 has a feature that, in addition to the image formation units 10 (10Y, 10M, 10C, 10K) for forming the four color images of yellow (Y), magenta (M), cyan (C), black (K) being the common color (general color), the image formation unit 10S for forming the toner images of a special color including a corporate color (for example, the yellow from X-corporation, the green from Y-corporation, etc.), foamed toner for the Braille, fluorescent color, brightness enhancing toner, and so forth is provided as one of the image formation units to form the tandem array. Each of the image formation units 10 (10S, 10Y, 10M, 10C, 10K) is provided with electro-photographic devices on the periphery of a photosensitive drum 11 that rotates in the direction of the arrow a, such as an electrifier 12 that electrifies the photosensitive drum 11, a laser exposure device 13 that writes electrostatic latent images into the photosensitive drum 11 (the exposure beams are shown by the symbol Bm in the drawing), a development device 14 that contains the toner of each color and makes visible the electrostatic latent images on the photosensitive drum 11 by the toner, a primary transfer roll 16 that transfers the toner image of each color formed on the photosensitive drum 11 onto the intermediate transfer belt 15, and a drum cleaner 17 that cleans off a residual toner on the photosensitive drum 11, etc.

The intermediate transfer belt 15 uses a polyimide or polyamide resin having an appropriate amount of the conductive materials such as a carbon black contained therein. The intermediate transfer belt 15 is made such that the volume resistivity thereof is within $10^6$ to $10^{14}$ Ω·cm, and is formed in a film-like endless belt with a thickness of about 0.1 mm. The intermediate transfer belt 15 is driven to circulate at a specific speed by means of various rolls in the direction β illustrated in the drawing. The various rolls include a drive roll 31 that drives to circulate the intermediate transfer belt 15, driven by a motor exceeding in the constant speed performance (not illustrated), a support roll 32 that supports the intermediate transfer belt 15 extending substantially linearly along the direction of the photosensitive drums 11 being aligned, a tension roll 33 functioning as a compensation roll, which gives a constant tension to the intermediate transfer belt 15 and prevents meandering of the intermediate transfer belt 15, a backup roll 22 installed in the secondary transfer unit 20, and an idle roll 34 installed on the downstream viewing from the secondary transfer unit 20 in the conveyance direction of the intermediate transfer belt 15.

Each of the primary transfer rolls 16 as a primary transfer mechanism is located to face to each of the photosensitive drums 11 inside the intermediate transfer belt 15 extending substantially linearly. A voltage of reverse polarity to the electrified polarity of the toner (positive polarity in this embodiment) is applied to each of the primary transfer rolls 16. Thereby, the toner images on each of the photosensitive drums 11 are sequentially electrostatically attracted into the intermediate transfer belt 15, thus forming a superposed toner image on the intermediate transfer belt 15.

The secondary transfer unit 20 as a secondary transfer mechanism is made up with a secondary transfer roll 21 positioned on the toner image retaining side of the intermediate transfer belt 15, and the backup roll 22, etc. The backup roll 22 is made of a blended rubber tube of EDPM and NBR, the surface thereof has a carton dispersed, and the inside thereof has an EDPM rubber contained. The backup roll 22 is formed such that the surface resistivity thereof is 7 to 10 log Ω/□, and the diameter thereof is 28 mm, and the hardness thereof is 70°, for example, (ASCOR type C). The backup roll 22 is positioned on the rear side of the intermediate transfer belt 15, and forms an electrode facing to the secondary transfer roll 21. And, a metal feed roll 23 to which a secondary transfer bias is stably applied is attached in contact with the backup roll 22.

A belt cleaner 35 is located on the downstream viewing from the secondary transfer unit 20 of the intermediate transfer belt 15 so as to face to the drive roll 31 with the intermediate transfer belt 15 put in-between, which is in contact with and freely detachable from the intermediate transfer belt 15. The belt cleaner 35 removes residual toners or paper powders on the intermediate transfer belt 15 after the secondary transfer, and cleans the surface of the intermediate transfer belt 15. On the other hand, a reference sensor (home position sensor) 41 is installed on the upstream of the yellow image formation unit 10Y, which generates a reference signal for making exact timings with the image formations in the image formation units 10 (10S, 10Y, 10M, 10C, 10K). An image density sensor 42 for regulating the image quality is located on the downstream of the black image formation unit 10K. The reference sensor 41 generates the reference signal on recognition of a specific mark attached on the rear side of the intermediate transfer belt 15. The image formation units 10 (10S, 10Y, 10M, 10C, 10K) are designed to start the image formations according to the instructions from the control unit 40 based on the recognition of the reference signal. Here, the image density sensor 42 monitors the density of toner patches formed on the intermediate transfer belt 15. On the basis of the monitoring result are controlled the supply of a developing powder and so forth, so as to maintain the toner density at a constant. A temperature sensor 47 and a humidity sensor 48 are placed inside the intermediate transfer belt 15.

Further, a vacuum conveyance unit 45 is provided on the downstream of the secondary transfer unit 20, which conveys the sheet P after the secondary transfer while attracting it. The vacuum conveyance unit 45 is to convey the sheet P having the toner images transferred thereon by the secondary transfer roll 21 to the fixing unit 46 while attracting the sheet P. The fixing unit 46 is to fix the toner images onto the sheet P by means of heating and pressuring and so forth. The fixing unit 46 in this embodiment includes a heating roll 46*a* positioned to face to the surface of the sheet P where the images are formed, a pressure belt 46*b* positioned with a pressure in contact with the heating roll 46*a*, which forms a fixing nip, and a halogen lamp 46*c* built in the heating roll 46*a* as a heating source.

On the other hand, the sheet feed unit 4 is to convey each sheet P contained in a first sheet tray 50, a second sheet tray 51, and a third sheet tray 52 by way of specific paths. Near the sheet trays 50, 51, and 52 are provided delivery rolls 53, 54, and 55, respectively, to correspond to each of the trays. Each of the delivery rolls 53 through 55 is to separate and pick out a sheet P one sheet by one sheet from the corresponding one of the trays 50 through 52, to nip the sheet P and temporarily halt it on the sheet conveyance path, and to send out the sheet P toward the downstream in the sheet conveyance direction in timing based on a specific start signal. Sheet type input units 50*a*, 51*a*, and 52*a* for inputting the type of the sheet P to be contained are attached to the first sheet tray 50, second sheet tray 51, and third sheet tray 52, respectively. An operation panel 56 that a user operates is provided near the image reader 2, a keyboard 56*a* is placed close to the operation panel 56, and a power supply 43 for this full color image formation system 1 is placed under the third tray 52. Here, the sheet type input units 50*a*, 51*a*, and 52*a* are not necessarily required to be attached to the trays 50, 51, and 52 each; and this may be arranged to input the sheet type on the operation panel 56 by use of the keyboard 56*a*.

Here, on a series of sheet conveyance paths R1 through R5 from the position where the sheet P is sent out by each of the delivery rolls 53 through 55 reaching to a discharge tray 57 by way of the position where the image formation processing is made in the image formation unit 3, conveyance rolls are appropriately provided to convey each sheet. The delivery roll 53 sends out the sheet P contained in the first tray 50, and then the sheet P passes through the first sheet conveyance path R1 to be sent into a combined conveyance unit 58. The delivery roll 54 sends out the sheet P contained in the second tray 51, and then the sheet P passes through the first sheet conveyance path R1 to be sent into the combined conveyance unit 58. On the other hand, the delivery roll 55 sends out the sheet P contained in the third tray 52 directly into the combined conveyance unit 58.

The sheet P sent into the combined conveyance unit 58 is sent into the secondary transfer unit 20 of the image formation unit 3 by way of the second sheet conveyance path R2. The sheet P passed through the secondary transfer unit 20 is sent into the fixing unit 46 by the vacuum conveyance unit 45; thereafter, it is discharged into the discharge tray 57 by way of the third sheet conveyance path R3. In contrast to this, the sheet P having images being formed on both the sides thereof passes through the fixing unit 46, and then it is sent into a face reversing unit 59 by way of the fourth sheet conveyance path R4, where the front and rear side of the sheet is reversed. Thereafter, the sheet P is sent again into the combined conveyance unit 58 by way of the fifth sheet conveyance path R5.

In the sheet conveyance paths R1 through R5, the second sheet conveyance path R2 is furnished with an attitude correction unit 60 and a resist roll 61. The attitude correction unit 60 is to correct the attitude of the sheet P conveyed through the second sheet conveyance path R2. The resist roll 61 includes a pair of rolls that are retained to be pressed in contact with each other. The resist roll 61 is to send the sheet P into the secondary transfer unit 20, by rotating the pair of rolls in timing based on a specific start signal, while nipping the sheet P between the pair of rolls. Further, the sheet conveyance paths R3 and R5 are furnished with curl correction units 62 and 63, respectively, which correct curls of the sheet P created during the fixing in the fixing unit 46.

In the image formation system 1 of this embodiment, primary transfer resistance measuring units 67 are installed to measure the combined resistances (primary transfer resistance) between each of the photosensitive drums 11, the intermediate transfer belt 15, and each of the primary transfer rolls 16, and a secondary transfer resistance measuring unit 68 is installed to measure the combined resistance (secondary transfer resistance) between the secondary transfer roll 21, the intermediate transfer belt 15, and the backup roll 22.

The basic image formation operation by the tandem type full-color image formation system 1 relating to this embodiment will now be explained. First, the image data formed by a personal computer (not illustrated) or the like is inputted to IPS (not illustrated), as reflectance data of respectively 8-bits of R (Red), G (Green), and B (Blue), for example. The IPS executes to inputted reflectance data the processing of various image editing such as: shading correction, position error correction, brightness/color space conversion, gamma correction, frame erasing and color editing, and motion editing, etc. The image data having the image processing applied thereto is converted into the color material gradation data of each color. Based on the image signals attained by the above, the image formation unit 3 forms the toner images. Here, according to circumstances, the image formation unit 3 can form the toner images, based on the image data of the original copy read by the image reader 2. The image formation unit 3, driving to rotate the five photosensitive drums 11, forms the toner images of the special color, yellow, magenta, cyan, and black by means of the electrifier 12, laser exposure device 13, and development device 14. The primary transfer rolls 16 sequentially transfer to superpose the toner images of respective colors thus formed, onto the intermediate transfer belt 15. Thereby, multi-color toner images with four or five color toner images superposed are formed on the intermediate transfer belt 15. The toner images formed on the intermediate transfer belt 15 are sent into the secondary transfer unit 20 in a state that they are retained on the intermediate transfer belt 15.

On the other hand, the sheet P on the tray selected by a user through the operation panel 56 or the sheet P on the tray selected by an automatic selection function is sent into the secondary transfer unit 20 by the resist roll 61 in the exact timing that the toner images on the intermediate transfer belt 15 reach the secondary transfer unit 20. For example, if the selected tray is the first tray 50, the sheet P sent out by the delivery rolls 53 is sent into the combined conveyance unit 58 by way of the first sheet conveyance path R1, the sheet P passes the second sheet conveyance path R2 to reach the attitude correction unit 60, where the attitude thereof is corrected, and thereafter the sheet P is sent into the secondary transfer unit 20 by the resist roll 61.

In the secondary transfer unit 20 of the image formation unit 3, the toner images (full color images) retained on the intermediate transfer belt 15 are transferred in a lump (secondary transfer) onto the sheet P by the secondary transfer roll 21. Thereafter, the sheet P having the toner images transferred thereon is sent into the fixing unit 46 by the vacuum conveyance unit 45, after the processing of heating and pressurizing, and fixing, and it is discharged into the discharge tray 57 by way of the third sheet conveyance path R3.

When the images are formed on both the sides of the sheet P, the sheet P having the images formed on one side thereof is sent into the face reversing unit 59 by way of the fourth sheet conveyance path R4, where the front and rear side of the sheet is reversed, and the sheet P is sent into the fifth sheet conveyance path R5. Thereafter, the sheet P having the images formed on one side thereof is conveyed on the fifth sheet conveyance path R5, then it comes to a delivery roll 64 provided near the end of the fifth sheet conveyance path R5, where it temporarily halts. The sheet P having the images formed on one side thereof is sent again into the combined conveyance unit 58, with the timing adjusted by the rotation of the delivery roll 64 based on a specific restart signal. After this, in the same manner as above, the toner images are transferred, fixed on the sheet, and the sheet is discharged into the discharge tray 57 by way of the third sheet conveyance path R3.

In the full-color image formation system 1 relating to this embodiment, the setting of image quality can be made to eliminate defects of the image quality by printing test charts with the image formation conditions varied, or to adjust the image quality to the preference of a user.

Figure 3:
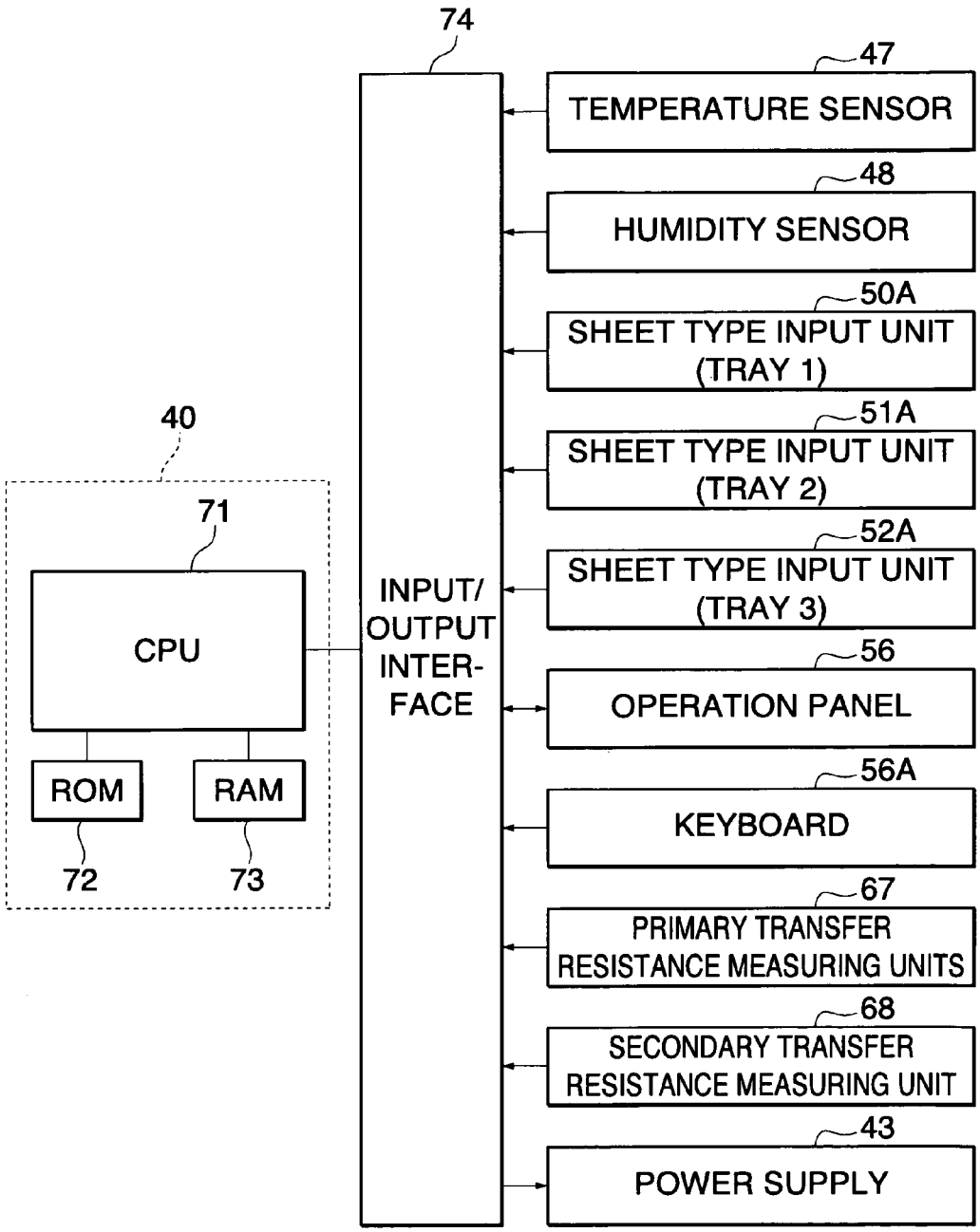
FIG. 3 is a block diagram of the hardware of the control unit.

FIG. 3 is a block diagram of the hardware of the control unit 40. A CPU 71 of the control unit 40 implements the processing according to the program stored in a ROM 72, while exchanging data with a RAM 73 appropriately. The control unit 40 is made to receive through an input/output interface 74: temperature data from the temperature sensor 47, humidity data from the humidity sensor 48, sheet type information from the sheet type input units 50*a* through 52*a*, control parameter data from the operation panel 56 and the keyboard 56*a*, primary transfer resistance data from the primary transfer resistance measuring units 67, and secondary transfer resistance data from the secondary transfer resistance measuring unit 68. The control unit 40 is to send out various control data to the operation panel 56 and voltage (current) control data to the power supply 43, through the input(output interface 74.

Figure 4:
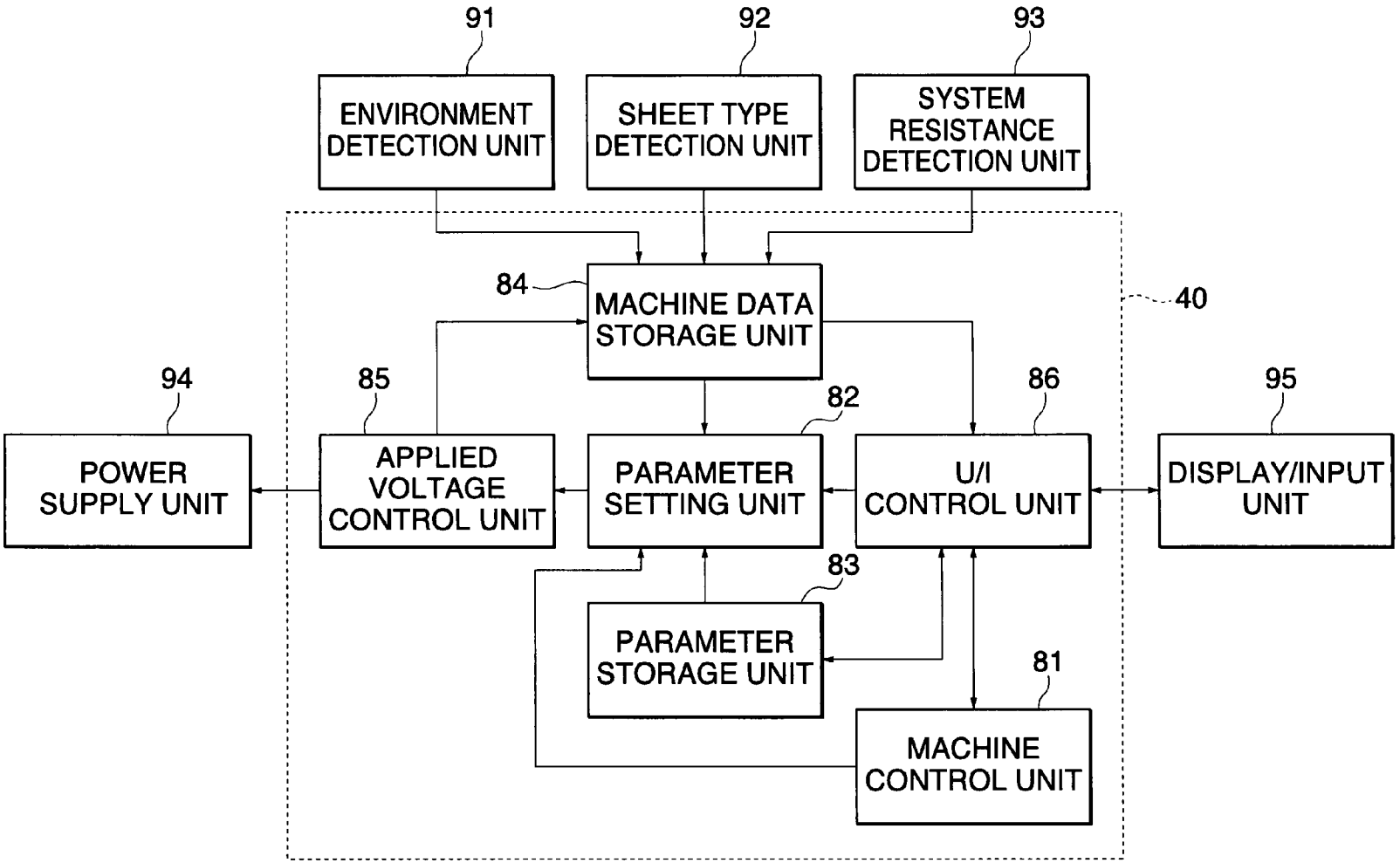
FIG. 4 is a block diagram of the software of the control unit.

FIG. 4 is a block diagram to explain the functions implemented by the control unit 40. FIG. 4 illustrates the function blocks of the software implemented by the CPU 71, ROM 72, and RAM 73 of the control unit 40. The control unit 40 includes: a machine control unit 81 that controls the whole operation of the full-color image formation system 1, a parameter setting unit 82 that sets various control parameters during the image formation, a parameter storage unit 83 that stores the control parameters set by the parameter setting unit 82, a machine data storage unit 84 that stores: temperature and humidity data inside the full-color image formation system 1 detected by an environment detection unit 91; tray data as to the sheet types of the sheet P contained in the sheet trays 50 through 52 detected by a sheet type detection unit 92; and primary transfer resistance data and secondary transfer resistance data monitored by a system resistance detection unit 93, applied voltage control unit 85 that controls the output voltage (applied voltage) of a power supply unit 94 to supply the power to the control objects, and a U/I control unit 86 that converts data to display the various information at given positions of a display/input unit 95, and converts data based on the input information accepted by the display/input unit 95.

The functions of the machine control unit 81, parameter setting unit 82, applied voltage control unit 85, and U/I control unit 86 are implemented by the function of the CPU 71, and the executed programs are stored in the ROM 72. The functions of the parameter storage unit 83 and machine data storage unit 84 are implemented by the function of the RAM 73. Further, the environment detection unit 91 is implemented by the functions of the temperature sensor 47 and humidity sensor 48, the sheet type detection unit 92 is implemented by the functions of the sheet type input units 50*a* through 52*a*, the system resistance detection unit 93 is implemented by the functions of the primary transfer resistance measuring units 67 and secondary transfer resistance measuring unit 68, the power supply unit 94 is implemented by the function of the power supply 43, and the function of the display/input unit 95 is implemented by the function of the operation panel 56 and the keyboard 56*a*.

In this embodiment, the machine control unit 81 controls the start/stop of the normal image formation operation inputted from the display/input unit 95 through the U/I control unit 86, for example. Also, the machine control unit 81 accepts the control parameter setting data of image formation conditions inputted from the display/input unit 95 through the U/I control unit 86, and based on the received setting data, controls the output operation of the test charts.

The parameter setting unit 82 accepts the temperature and humidity data, and the tray data from the machine data storage unit 84, accepts a file designation relating to the setting of control parameters of the image formation conditions inputted from the display/input unit 95 through the U/I control unit 86, extracts a control parameter group corresponding to the conditions from the parameter storage unit 83, further executes a calculation in consideration for the system characteristics extracted from the machine data storage unit 84, and sets to create output parameters.

The applied voltage control unit 85 controls the power supply unit 94 so that the power supply unit 94 will output a voltage (or current) designated on the basis of the instruction from the parameter-setting unit 82. In this embodiment, the control object includes: primary transfer biases applied to the primary transfer rolls 16, a secondary transfer bias applied to the feed roll 23 of the secondary transfer unit 20, a supply power to the halogen lamp 46*c* of the fixing unit 46, and a supply power to a drive motor (not illustrated) that drives the heating roll 46*a* of the fixing unit 46.

Figure 5:
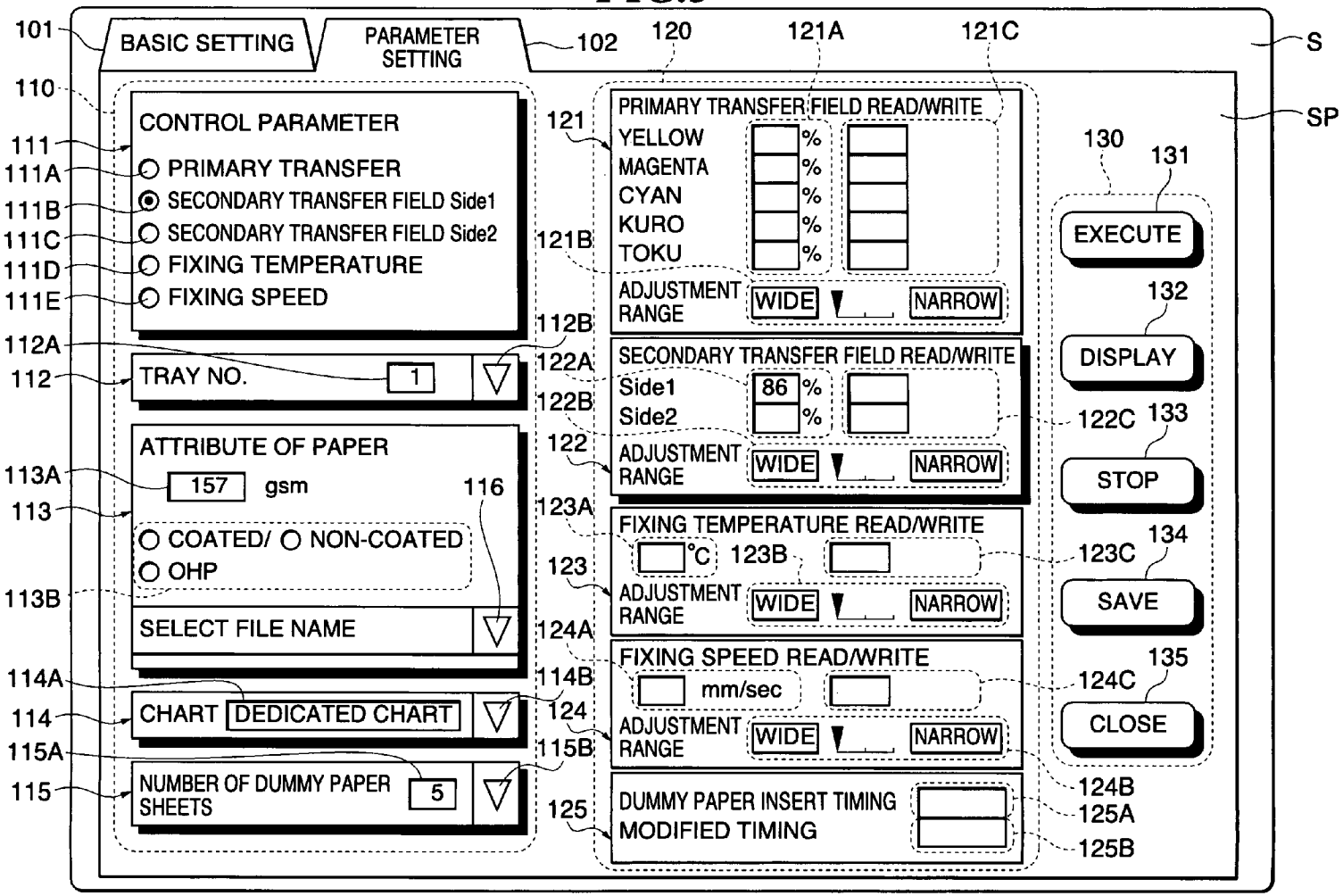
FIG. 5 is an illustration to explain a parameter setting screen.

FIG. 5 illustrates a setting screen S displayed on the operation panel 56 (see FIG. 1) of the fill-color image formation system 1. In this embodiment, the setting screen S can be switched into a basic setting screen (not illustrated) used in executing the basic image formation operations such as setting of the number of sheets printed and start/stop of the image formation operation, or a parameter setting screen Sp used for inputting various control parameters when the image quality setting is executed. The switching of the basic setting screen or the parameter setting screen Sp can be done by touching a basic setting selection tab 101 provided on the upper part of the setting screen S or a parameter setting selection tab 102. That is, it is possible to call the parameter-setting screen Sp from the basic setting screen by one touch.

The parameter-setting screen Sp has a basic condition selection area 110, a detailed condition selection area 120, and an operation area 130 in order from the left of the screen. In the basic condition selection area 110 are laid out in order from the top of the screen: a setting parameter selection area 111, a tray number selection area 112, a sheet information display area 113, a use chart selection area 114, and a dummy sheet number selection area 115. And, in the detailed condition selection area 120 are laid out in order from the top of the screen: a primary transfer field setting area 121, a secondary transfer field setting area 122, a fixing temperature setting area 123, a fixing speed setting area 124, and a timing setting area 125 for inserting a dummy sheet. Further, in the operation area 130 are laid out in order from the top of the screen: an execute button 131, a display button 132, a stop button 133, a save button 134, and a close button 135.

In the basic condition selection area 110, the setting parameter selection area 111 is an area for selecting control parameters (image formation conditions) to be then set, and the adjustable items in this embodiment includes the primary transfer field, secondary transfer field Side1 (at the image formation to the front face of the sheet P), secondary transfer field Side2 (at the image formation to the rear face of the sheet P), fixing temperature, and fixing speed, however, the setting parameter selection area 11 is made to select one of the above items. That is, it is impossible to select two adjustable items at one time. The selection of the control parameters is made by touching any one of the radio buttons 111*a* through 111*e* on the left side inside the setting parameter selection area 111. FIG. 5 shows the state that the radio button 111*b*, namely, the secondary transfer field Side1 is selected.

The tray number selection area 112 is an area for displaying to select the number of the tray that contains the sheet P used in the image quality setting operation, from the first tray 50 (tray 1), second tray 51 (tray 2), and third tray 52 (tray 3), which possesses a tray display area 112*a* to display the tray number. Here, the tray number can be selected from a pull-down menu (not illustrated) by touching a selection button 112*b* on the left side of the tray number selection area 112.

The sheet information display area 113 is an area for displaying the attribute (sheet information) of the sheet P contained in the tray having been selected in the tray number selection area 112, which possesses from the upper part a basic weight display area 113*a* to display the basic weight of the sheet P to be used, and a sheet type display area 113*b* to display the types of the sheet P to be used (in this example, coated or non-coated, OHP or not). On the lower part of the sheet information display area 113 is located a call button 116 for selecting the control parameter setting files already formed and stored. The setting files can be selected from a pull-down menu displayed (not illustrated) by touching the call button 116. The setting files are stored in the parameter storage unit 83 (see FIG. 4).

Further, the use chart selection area 114 is an area for displaying to select test charts to be used for the setting, which possesses a chart display area 114*a* to display the types of the test charts. As mentioned later, this embodiment provides the test charts of the primary transfer field, secondary transfer fields (Side1, Side2), fixing temperature, and fixing speed, which are dedicated for setting the image quality. The dedicated test charts are to be displayed on the chart display area 114*a* as the default value. However, the types of the test charts can be selected from a pull-down menu displayed (not illustrated) by touching a selection button 114*b* on the right side of the use chart selection area 114, which functions as the image selection part. The test charts including the dedicated charts are stored in the parameter storage unit 83.

And, the dummy sheet number selection area 115 is an area for selecting the number of sheets of the sheet P to be carried before printing the test charts, which possesses a dummy sheet number display area 115*a* to display the number of dummy sheets. In this example, five sheets are to be displayed as the default value in the dummy sheet number display area 115*a*. This default value is stored in the parameter storage unit 83. The number of the dummy sheets can be selected from a pull-down menu displayed (not illustrated) by touching a selection button 115*b* on the right side of dummy sheet number display area 115*a*, which can also be inputted directly from the keyboard 56*a* (see FIG. 1).

In the detailed condition selection area 120, the primary transfer field setting area 121 is an area for selecting detailed control parameters on setting the primary transfer biases, namely, the primary transfer fields to be applied to the primary transfer rolls 16. In this embodiment, the primary transfer field setting area 121 includes: a primary transfer bias input field 121*a* that inputs/displays the magnitudes of the primary transfer biases for the yellow, magenta, cyan, black (Kuro in the drawing), and special color (Toku in the drawing) in terms of the magnifying factors (percentage), a primary transfer adjustment range setting unit 121*b* for setting the adjustment range of the primary transfer bias in the test chart to be outputted, and a primary transfer evaluation input field 121*c*for inputting the outputted order of the test chart that was evaluated as preferable on the basis of the output result of the test charts. Here, the input of numeric values to the primary transfer bias input field 121*a* and the primary transfer evaluation input field 121*c*is carried out through the keyboard 56*a* (see FIG. 1). In the primary transfer adjustment range setting unit 121*b* as a part of designating the setting range, the adjustment range of three phases (wide, normal, narrow) can be selected by touching 'wide' button or 'narrow' button displayed on the operation panel 56.

The secondary transfer field setting area 122 is an area for selecting detailed control parameters on setting the secondary transfer bias, namely, the secondary transfer fields (Side1, Side2) to be applied to the feed roll 23. The secondary transfer field setting area 122 includes: a secondary transfer bias input field 122*a* that inputs/displays the magnitudes of the secondary transfer biases for Side1 and Side2 in terms of the magnifying factors (percentage), a secondary transfer adjustment range setting unit 122*b* for setting the adjustment range of the secondary transfer bias in the test chart to be outputted, and a secondary transfer evaluation input field 122*c* for inputting the outputted order of the test chart that was evaluated as preferable on the basis of the output result of the test charts. Here, the input of numeric values to the secondary transfer bias input field 122*a* and the secondary transfer evaluation input field 122*c* as an acceptance unit is carried out through the keyboard 56*a* (see FIG. 1). And, in the same manner as the primary transfer adjustment range setting unit 121*b*, in the secondary transfer adjustment range setting unit 122*b*, the adjustment range of three phases (wide, normal, narrow) is made selectable.

The fixing temperature setting area 123 is an area for selecting detailed control parameters on setting the supply power to be supplied to the halogen lamp 46*c*, namely, the fixing temperature. The fixing temperature setting area 123 includes: a fixing temperature input field 123*a* that inputs/displays the height of a fixing temperature by Celsius (° C.), a fixing temperature adjustment range setting unit 123*b* for inputting the adjustment range of the fixing temperature in the test chart to be outputted, and a fixing temperature evaluation input field 123*c* for inputting the outputted order of the test chart that was evaluated as preferable on the basis of the output result of the test charts. Here, the input of numeric values to the fixing temperature input field 123*a* and the fixing temperature evaluation input field 123*c* is carried out through the keyboard 56*a* (see FIG. 1). In the same manner as the primary transfer adjustment range setting unit 121*b*, in the fixing temperature adjustment range setting unit 123*b*, the adjustment range of three phases (wide, normal, narrow) is made selectable.

The fixing speed setting area 124 is an area for selecting detailed control parameters on setting the speed of driving to rotate the heating roll 46*a*, namely, the fixing speed. The fixing speed setting area 124 includes: a fixing speed input field 124*a* that inputs the height of a fixing speed by the speed per second; a fixing speed adjustment range setting unit 124*b* for inputting the adjustment range of the fixing speed in the test chart to be outputted; and a fixing speed evaluation input field 124*c* for inputting the outputted order of the test chart that was evaluated as preferable on the basis of the output result of the test charts. Here, the input of numeric values to the fixing speed input field 124*a* and the fixing speed evaluation input field 124*c* is carried out through the keyboard 56*a* (see FIG. 1). In the same manner as the primary transfer adjustment range setting unit 121*b*, also in the fixing speed adjustment range setting unit 124*b*, the adjustment range of three phases (wide, normal, narrow) is made selectable.

The timing setting area 125 for inserting a dummy sheet is an area for selecting detailed control parameters on setting the fixing temperature or the fixing speed, which includes a dummy sheet insert timing input field 125*a* that inputs a timing of inserting a dummy sheet, and a modified timing display field 125*b* that displays that at each of which minutes the fixing condition is modified.

In the operation area 130, the execute button 131 is a button to be touched when printing a test chart. The display button 132 is a button to be touched when redisplaying (updating) the parameter-setting screen Sp. The stop button 133 is a button to be touched when halting to print the test chart. The save button 134 is a button to be touched when storing the modified image formation conditions and so forth. The close button 135 is a button to be touched when terminating the display of this parameter-setting screen Sp, and when the parameter-setting screen Sp is closed, the foregoing basic setting screen (not illustrated) is displayed.

The areas displayed with shadows in FIG. 5 are active areas where the setting is now possible. In the example shown in FIG. 5, since the secondary transfer field Side 1 is selected as the control parameter, only the secondary transfer field setting area 122 is made active in the detailed condition selection area 120. The other areas, namely primary transfer field setting area 121, fixing temperature setting area 123, fixing speed setting area 124, and timing setting area 125 are grayed out, so that the operations thereof are impossible. In this case, the secondary transfer bias input field 122*a* of the secondary transfer field setting area 122 is made to display the default value [86%] of the secondary transfer field.

Figure 6:
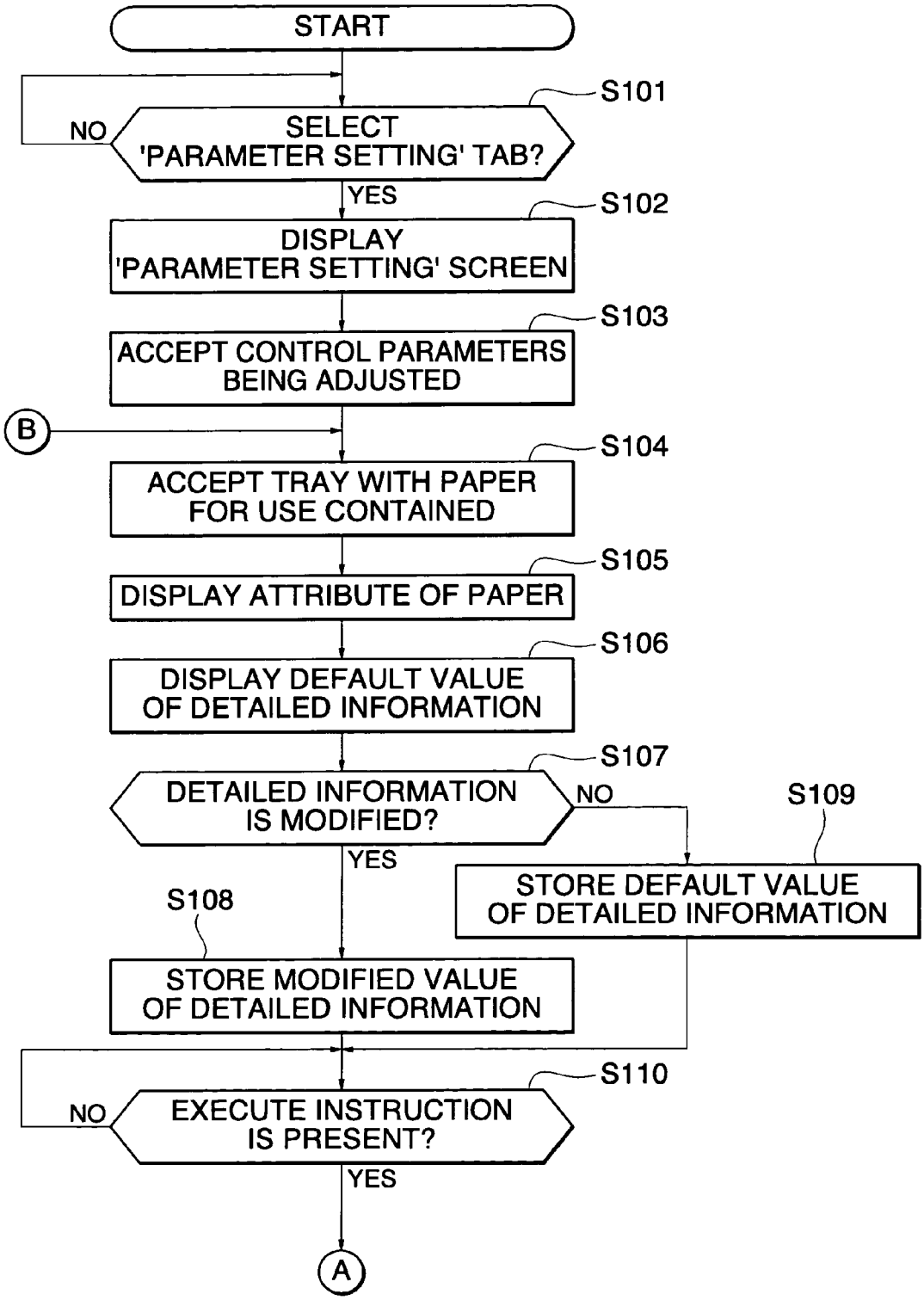
FIG. 6 is a flowchart illustrating the processing flow in the image quality setting operations.
Figure 7:
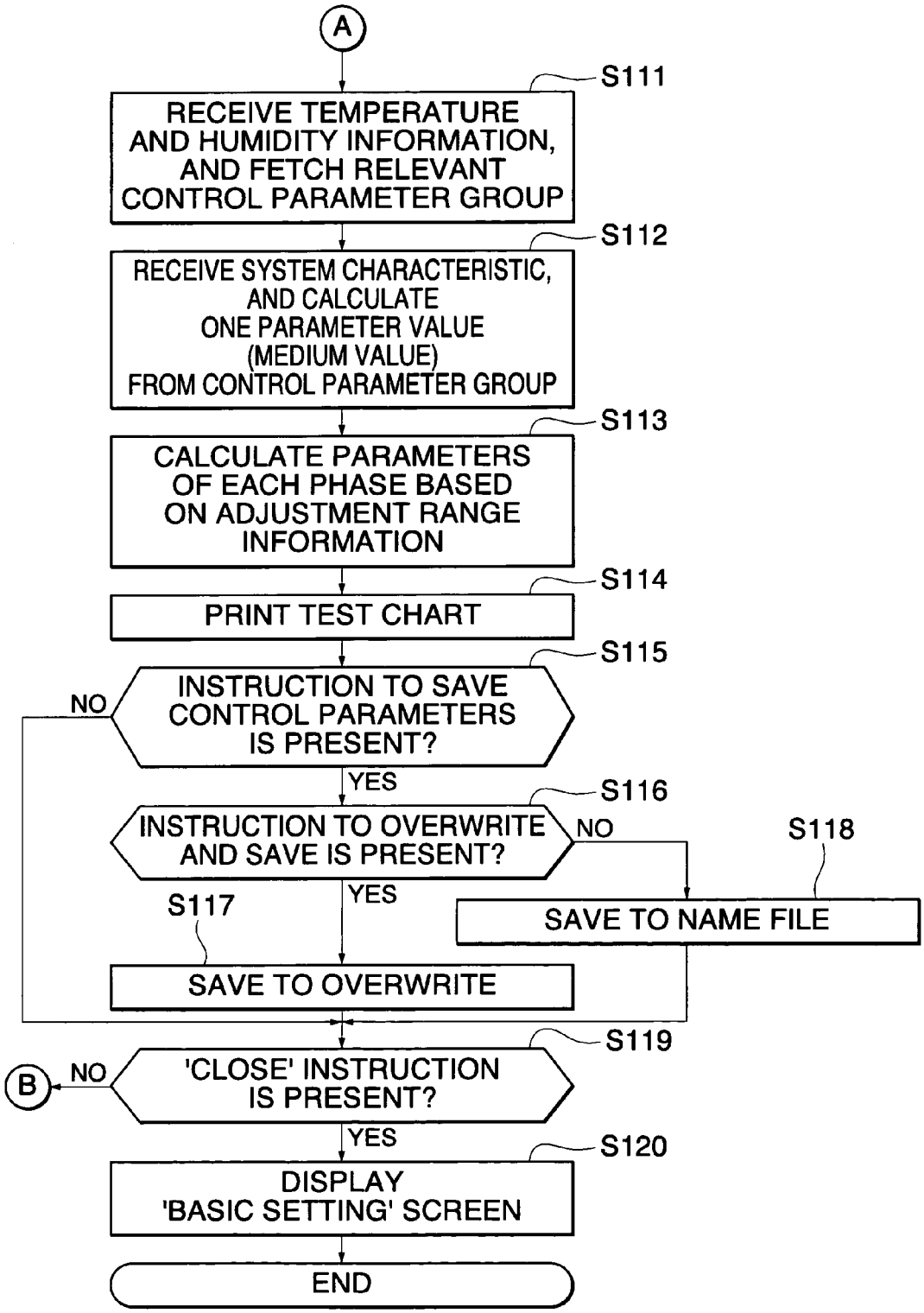
FIG. 7 is a flowchart illustrating the processing flow in the image quality setting operations (continued from FIG. 6)

Next, the image quality setting operations in this embodiment will be described. FIG. 6 and FIG. 7 constitute a flowchart illustrating the basic processing flow in the image quality setting operations. In the first place, the total processing flow of the image quality setting operations including the primary transfer field, secondary transfer fields (Side1, Side2), fixing temperature, and fixing speed will be explained, and then the image quality setting operations in each setting objects will be explained in detail with typical examples.

First, Step S101 determines whether or not the user selects the 'parameter setting' tab on the operation panel 56, namely, whether or not the user touches the 'parameter setting' tab. If the 'parameter setting' tab is not selected, the step waits for the selection of the 'parameter setting' tab as it is. If the 'parameter setting' tab is selected, Step S102 displays the parameter-setting screen Sp on the operation panel 56, and Step S103 accepts the input of the control parameters to be set in the setting parameter selection area 111. Next in the tray number selection area 112, Step S104 accepts inputting the number of the tray containing the sheet P to be used in this image quality setting operations. Step S105 displays the attributes (sheet attributes) of the sheet P contained in the tray of the accepted tray number on the sheet information display area 113. Step S106 displays the default value of the detailed information in the setting object area (any of the primary transfer field setting area 121, secondary transfer field setting area 122, fixing temperature setting area 123, and fixing speed setting area 124) in the detailed condition selection area 120. Here, if step 101 designated the fixing temperature or the fixing speed, Step S106 displays the default value of the detailed information also in the timing setting area 125 for inserting a dummy sheet. Also, Step S106 selects the default values of the primary transfer adjustment range setting unit 121*b*, secondary transfer adjustment range setting unit 122*b*, fixing temperature adjustment range setting unit 123*b*, and fixing speed adjustment range setting unit 124*b* from the maximum values of the three phases.

Next, Step S107 determines whether or not the displayed detailed information are modified, concretely, whether or not the user made any inputs to the detailed information; if the detailed information are modified, Step S108 stores the modified values of the detailed information, and if the detailed information are not modified, Step S109 stores the default value of the detailed information. And, the processing flow is put in wait, until any execute instruction comes in, concretely, until the user touches the execute button 131.

If Step S110 determines that there is an execute instruction, Step S111, receiving the temperature and humidity information from the temperature sensor 47 and humidity sensor 48, fetches the control parameter group suitable for the present environment conditions. Next, receiving the system characteristic information from the primary transfer resistance measuring units 67 and the secondary transfer resistance measuring unit 68, Step S112 calculates one parameter value from the fetched control parameter group.

Further, Step S113 calculates the parameters of the phases each on the basis of the stored adjustment range information (the setting values of the primary transfer adjustment range setting unit 124*b*, secondary transfer adjustment range setting unit 122*b*, fixing temperature adjustment range setting unit 123*b*, and fixing speed adjustment range setting unit 124*b*). Here, the control parameter group means various control parameters to be used for the setting objects selected (primary transfer field, secondary transfer fields, fixing speed, and fixing temperature). And, Step S114 executes printing the test chart on the basis of the set image formation conditions.

After the test printing, Step S115 determines whether or not there is the instruction to save the control parameters; if there is the instruction to save, Step S116 determines whether or not there is the instruction to overwrite and save; if there is the instruction to overwrite and save, Step S117 saves to overwrite the setting file; and if there is not the instruction to overwrite and save, Step S118 saves to name the setting file. Now, if there is not the instruction to save the control parameters at Step S115, the step moves to the next Step S119 as it stands. Step S119 determines whether there is the 'close' instruction, namely, whether the user touched the close button 135. And, if there is the 'close' instruction, Step S120 displays the basic setting screen on the operation panel 56 in replacement for the parameter-setting screen Sp, and terminates a series of processing. On the other hand, if there is not the 'close' instruction at Step S119, the step returns to Step S104 to continue the processing.

Next, supposing a case of implementing the image quality setting by adjusting the secondary transfer field (secondary transfer field Side1 in this case), the case will be explained with a concrete example. When the user is performing the setting of the secondary transfer field, the user touches the parameter setting selection tab 102 on the setting screen S shown in FIG. 5. Then, Step S101 determines that the parameter setting selection tab 102 was selected, and Step S102 displays the parameter-setting screen Sp shown in FIG. 5 as the setting screen S.

Next, if the user touches the radio button 111*b* inside the setting parameter selection area 111 of the parameter-setting screen Sp, it will select the secondary transfer field Side1 as the control parameter accepted at Step S103. If the user touches the selection button 112*b* inside the tray number selection area 112, it will select the tray to be accepted at Step S104. As the tray is selected, the tray number selected (1 in this example) is displayed on the tray display area 112*a*. Next, Step S105 displays, in the sheet information display area 113, the sheet information (the basic weight 157 gsm, coated, in this example) of the sheet P contained in the selected tray (tray 1 (sheet tray 50) in this example). The sheet information is inputted in advance from the sheet type input unit 50*a*. And, the 'dedicated chart' of the default value is displayed on the chart display area 114*a* inside the use chart selection area 114, and '5' (sheets) of the default value is displayed on the dummy sheet number display area 115*a* inside the dummy sheet number selection area 115.

Next, Step S106 displays the strength of the secondary transfer bias (86% in this case) as the default value of the detailed information, which is determined from the sheet type, in the secondary transfer bias input field 122*a* (Side1) of the secondary transfer field setting area 122; and it also displays the adjustment range (the maximum value in this example) in the secondary transfer adjustment range setting unit 122*b*. And, at the time when the secondary transfer field (Side1) is designated at Step S103, the secondary transfer field setting area 122 of the detailed condition selection area 120 is displayed with shadows (becomes active), which shows the area being capable of accepting the operation by the user.

And, if the user touches the parameter setting screen Sp, or operates the keyboard 56*a* (see FIG. 1), it enables accepting the modification of the detailed information at Step S107. In this example, the image quality setting operations are carried out from the default value without modifications, and Step S109 stores the default value of the detailed information (strength of the secondary transfer field: 86%, adjustment range: maximum value). On the other hand, if there is a modification, Step S108 stores the modified value of the detailed information. In addition to the detailed information, the type of the test charts to be used (dedicated chart, user specified chart) and the number of the dummy sheet can be modified, however this example uses the default value as it is.

If the user touches the execute button 131 on the parameter setting screen Sp, Step S110 will determine it as the execute instruction; accordingly, Step S111 will fetch the control parameter group, Step S112 will calculate the medium value, and Step S113 will calculate the parameters of the phases each. Further in detail, the followings are implemented in Step S111 through Step S113.

The magnitude of the secondary transfer field is generally controlled and set according to the characteristics of the secondary transfer roll 21, backup roll 22, and transfer belt 15, and the characteristics of the temperature and humidity in operation and the sheet P. There is the control formula in the case the control unit 40 controls the secondary transfer field, which is generally used, as follows:

$$Y=Ax+B$$

Here, Y: control output voltage

A, B: control coefficient

X: control variable

The control coefficients A, B are used for the differentials of part of the characteristics of the sheet P and the characteristics of the toner, against the temperature and humidity, and they are selected from a prepared table according to the state (temperature and humidity) at that moment. The control valuables x are used for the dispersions within tolerances of the resistances of the secondary transfer roll 21, backup roll 22, and transfer belt 15, and for the resistance differentials due to the temperature and humidity at that moment. The dispersions of the resistances and resistance differentials are monitored as those of the combined resistances at a constant interval, and the results are used for the control valuables x.

Under such circumstances, in order to handle a great variety of the sheet P, the control coefficients A, B prepared only for a specific type of the sheet P are only needed to prepare by the number of the sheet types, however this is not realistic. Accordingly, it is a common exercise to make a fine adjustment by further using an adjustment coefficient C in regard to the original control formula. That is:

$$Y=(Ax+B)\times C$$

In this example, the adjustment coefficient C is 86% (default value of the secondary transfer field displayed on the secondary transfer bias input field 122*a*).

The control coefficients A, B and the control valuable x are acquired at Step S111, and the output voltage Y as the medium value is calculated on the basis of these and the adjustment coefficient C at Step S112.

Table 1 gives the control coefficients A, B and adjustment coefficient C that are set in advance by the environment conditions and the sheet types each, which are stored in the parameter storage unit 83. Here, Table 1A shows the area where the coefficients used for the standard setting are stored, and Table 1B shows the area where the coefficients used for a user particular setting are stored.

TABLE 1A

| | | Environment condition | | | | Relative value |
|---|---|---|---|---|---|---|
| | | α | β | γ | . . . | rewrit-able |
| Basic weight/sheet type | Coated paper 61–80 gsm | $a_{11}=100$ | $a_{12}=100$ | $a_{13}=85$ | . . . | $c_1=70$ |
| | | $b_{11}=22$ | $b_{12}=25$ | $b_{13}=19$ | . . . | |
| | Non-coated paper 61–80 gsm | $a_{21}=100$ | $a_{22}=100$ | $a_{23}=88$ | . . . | $c_2=72$ |
| | | $b_{21}=19$ | $b_{22}=23$ | $b_{23}=19$ | . . . | |
| | Coated paper 81–100 gsm | $a_{31}=90$ | $a_{32}=100$ | . . . | . . . | $c_3=70$ |
| | | $b_{31}=22$ | $b_{32}=25$ | . . . | . . . | |
| | Non-coated paper 81–100 gsm | . . . | . . . | . . . | . . . | . . . |
| | | . . . | . . . | . . . | . . . | . . . |
| | . . . | . . . | . . . | . . . | . . . | . . . |
| | . . . | . . . | . . . | . . . | . . . | . . . |

TABLE 1B

| | |
|---|---|
| User setting value 1 | $c_{101}=100$ |
| User setting value 2 | $c_{102}=90$ |
| . . . | . . . |
| . . . | . . . |

Table 1 shows that, for example, in the case the environment condition is?, and the paper is coated paper of the sheet type 75 gsm, the parameter storage unit 83 sends $A=a_{11}=100$, $B=b_{11}=22$, and $C=c_1=70$ to the parameter setting unit. Also, Table 1 shows that, for example, in the case the environment condition is ?, the paper is a non-coated paper of the sheet type 75 gsm, and the user selects the file of the user setting value 1, the parameter storage unit 83 sends $A=a_{22}=100$, $B=b_{22}=23$, and $C=C_{101}=100$ to the parameter setting unit.

And, Step S113 sets the range of a setting adjustment coefficient Z in order to determine the adjustment range for acquiring an optimum adjustment coefficient C. That is:

$$Y=[(Ax+B)\times C]\times Z$$

In this embodiment, the adjustment range of the adjustment coefficient C, namely, the setting adjustment coefficient Z is selected from the three phases in the aforementioned secondary transfer adjustment range setting unit 122*b*. Here, the parameters (secondary transfer condition) are calculated to make up ten phases (50 to 140%) in units of 10% with Z=100% put in the center, in the case of the maximum value being designated, to make up ten phases (80 to 125%) in units of 5% with Z=100% put in the center, in the case of the medium value being designated, and to make up ten phases (96 to 105%) in units of 1% with Z=100% put in the center, in the case of the minimum value being designated. In this embodiment, since the maximum value of the default value is designated as the adjustment range, the parameters are calculated within 50 to 140% to the medium value.

Figure 8:
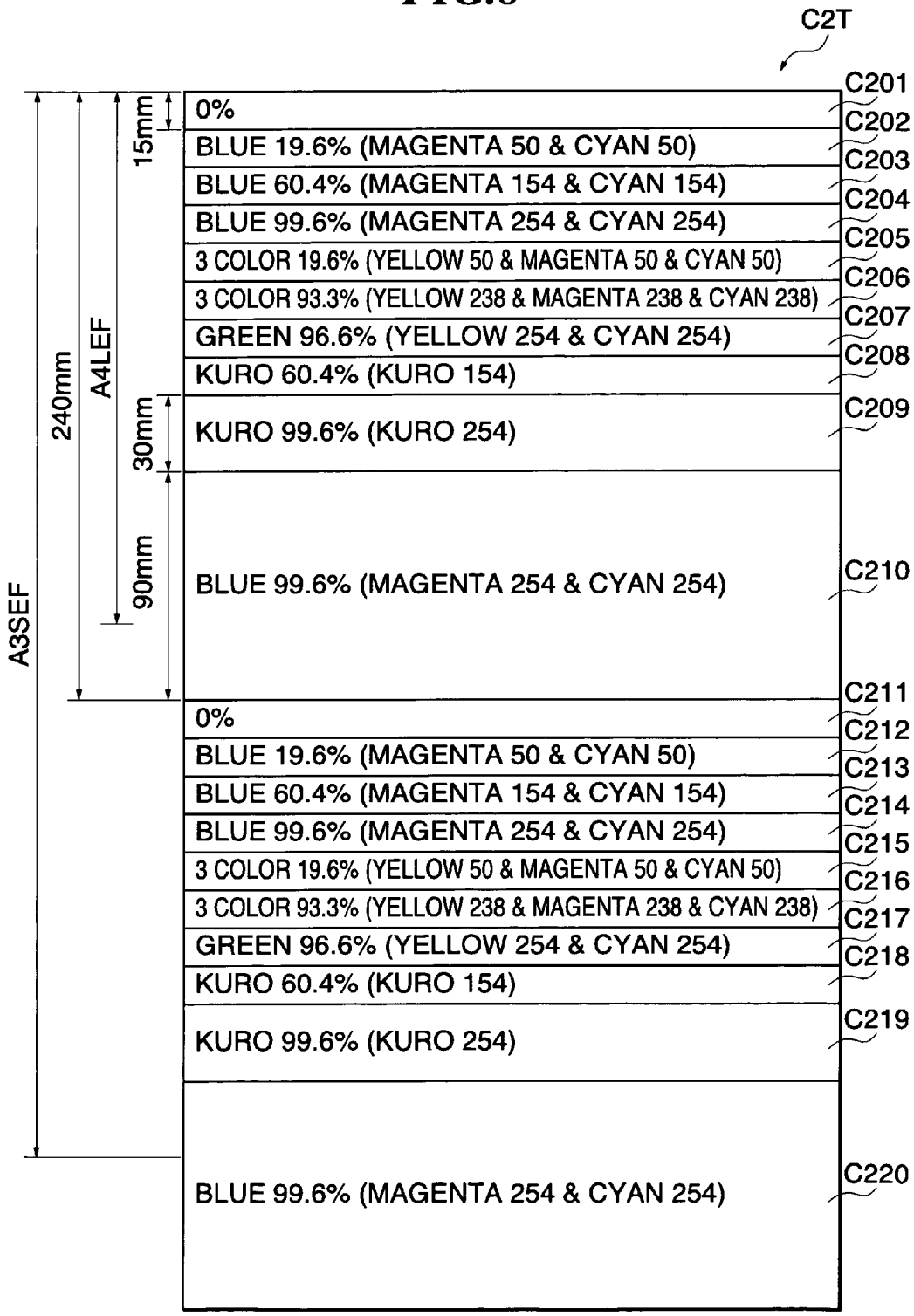
FIG. 8 is a chart to explain a secondary transfer test chart.

Step S114 prints the test chart as follows. FIG. 8 gives a secondary transfer test chart C2T used for the dedicated chart for setting the secondary transfer field. In the secondary transfer test chart C2T, the upper part of the drawing corresponds to the front side of the sheet P. The test chart C2T possesses the following regions from the upper to the downward: an achromatic color region (non-image formation area) C201, a light blue region C202, a medium blue region C203, a dark blue region C204, a light processed black (YMC three colors mixed) region C205, a dark processed black region C206, a green region C207, a light black region C208, a thick black region C209, and a dark blue region C210; and after this dark blue region C210, the test chart C2T possesses color regions C211 to C220 in the same order. In this embodiment, the length in the conveyance direction of the regions C201 to C208 and that of the regions C211 to C218 are both 15 mm, the length in the conveyance direction of the region C209 and that of the region C219 are both 30 mm, and the length in the conveyance direction of the region C209 and that of the region C219 are both 90 mm. Therefore, if the sheet P of the JIS A4 size is conveyed in the direction of the shorter size thereof (A4LEF), the center region of the region C210 is formed on the rear part of this sheet P. If the sheet P of the JIS A3 size is conveyed in the longitudinal direction (A3SEF), the center region of the region C220 is formed on the rear part of this sheet P. That is, in the secondary transfer test chart C2T, the image of very high density is to be arranged on the rear part of the sheet P of general size. Further, in the secondary transfer test chart C2T, the toner images are to be formed along the direction orthogonal to the sheet conveyance direction, accordingly the toner images are formed to the side edge part of the sheet P. Here, those given in the parentheses in FIG. 8 signify the density of the toner image of each color (for example, 'Magenta54' signifies $54^{th}$ gradation of magenta of the total 225 gradations (8 bits)).

Figure 9:
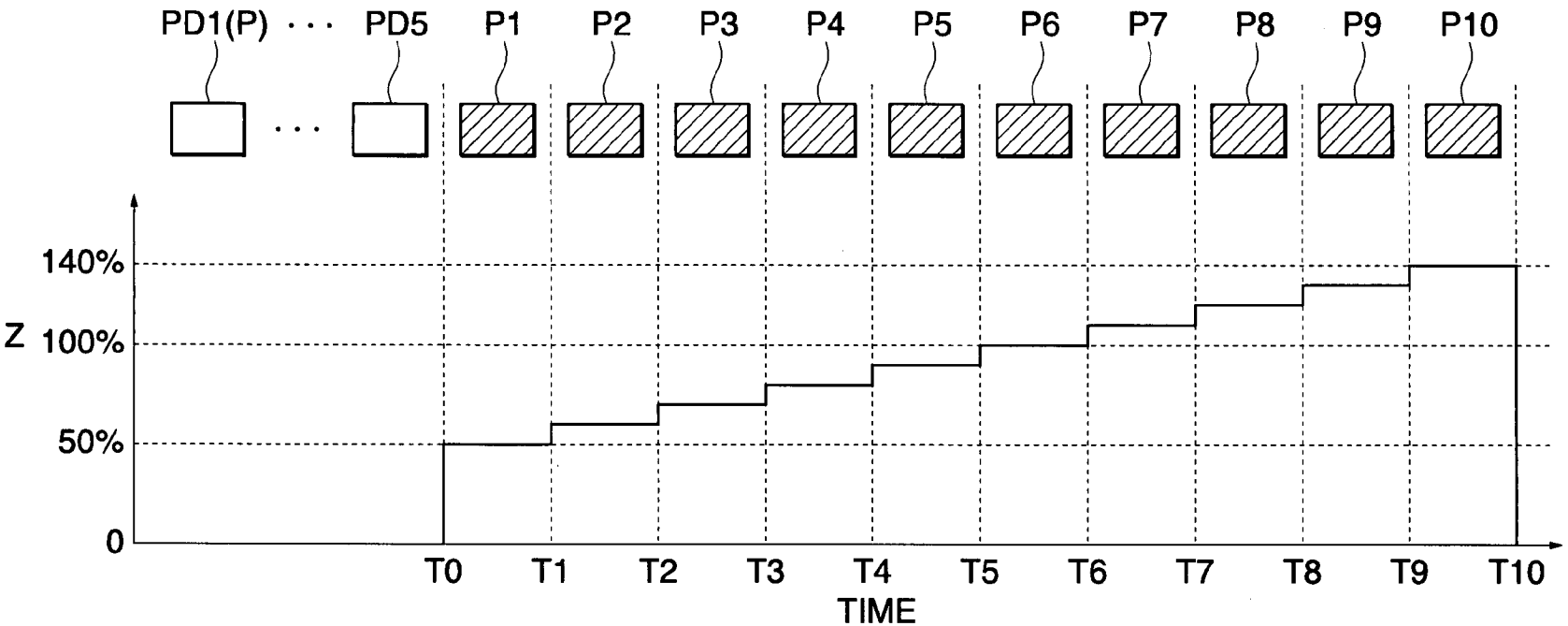
FIG. 9 is a timing chart to explain the setting process of the secondary transfer field.

FIG. 9 illustrates the timing chart in Step S114. As the printing operation of the test chart is started at time 0, first, preset five dummy sheets PD1 through PD5 are conveyed and discharged. The dummy sheets PD1 through PD5 are used in order to remove the oil adhered to the fixing unit 46 (see FIG. 1), on which the test chart or a blank chart is formed with the secondary bias applied at the currently set value. Next, within the time t0 between the time that the last dummy sheet PD5 passes through the secondary transfer unit 20 (see FIG. 2) and the time that the first sheet P1 charges into the secondary transfer unit 20, the application of the lowest secondary transfer bias (Z=50%) is started. The secondary transfer test chart C2T formed by the image formation unit 3 is secondarily transferred onto the sheet P1 under this secondary transfer condition, is fixed by the fixing unit 46, and is discharged into the discharge tray 57. Within the time t1 between the time that the first sheet P1 passes through the secondary transfer unit 20 and the time that the next sheet P2 charges into, the application of the next lowest secondary transfer bias (Z=60%) is started. The secondary transfer test chart C2T formed by the image formation unit 3 is secondarily transferred onto the sheet P2 under this secondary transfer condition, is fixed by the fixing unit 46, and is discharged into the discharge tray 57. Thereafter, at each time of t2 to t9 when the sheet passes through the secondary transfer unit 20, the secondary transfer bias is sequentially raised by 10%, and the same secondary transfer test chart C2T is printed onto the sheets P3 through P10. At the time t10 after the last sheet P10 passes through the secondary transfer unit 20, the secondary transfer bias is turned OFF to terminate a series of operations. Thus, the series of operations attain ten sheets of P1 through P10, on each of which the secondary transfer test chart C2T with the different secondary transfer condition is printed.

Next, the user confirms by viewing ten sheets of P1 through P10 having the secondary transfer test chart C2T printed, and determines the best one or the most preferable one of the image quality. In this case, the images of the same density are formed over the whole areas of the sheets P1 through P10 in the direction orthogonal to the conveyance direction (for example, the regions. C202 to C209). Accordingly, it is possible to easily detect both the imperfections of image quality likely to be created on the center in the conveyance direction of the sheet P, and the imperfections of image quality likely to be created on the side edges in the conveyance direction. Also, the imperfections of image quality to be created only on very limited parts can easily be detected. On the sheet P are formed the images of monochrome (for example, C208 and C209) and the images of plural colors (for example, C202 to C207). Therefore, it is possible to view at the same time the imperfections of image quality (for example, decrease of density) likely to be created in the case of monochrome and the imperfections of image quality (for example, retransfer) likely to be created in the case of plural colors. Further, since the high-density image and the low-density image of the same color system are formed on the sheet P (for example, the regions C202 to C204), it is possible to view the imperfections of image quality to be created depending on the density of image (for example, decrease of density in the case of low density, mottle and imperfections of fixing in the case of high density). Further, since the high-density image of plural colors is formed on the rear part of the sheet P (for example, region C210 in the case of JIS4LEF, region C220 in the case of JISA3SEF), it is possible to view the presence of smear likely to be created on the rear end of the sheet in the secondary transfer.

After performing these confirmations by the viewing of the image quality, the user writes the page number in the secondary transfer evaluation input field 122*c*. In this example, the $9^{th}$ sheet from the dummy sheet PD1 (namely, sheet P4) is inputted as the page number, where the image quality is evaluated as the best.

And, if the user touches the save button 134, Step S115 will accept it as the save instruction of the control parameters. Then, a pop-up window (not illustrated) for designating the name of the file to be saved is displayed in the setting screen S. After the user selects to or not to overwrite the setting file at Step S116, Step S117 saves to overwrite the file, or Step S118 saves to name the file. The saved setting file is used on forming the images on the next occasion with this sheet P (contained in the sheet tray 50 (tray number 1) in this example).

After the secondary transfer field is determined through such image quality setting operations, the image formation is performed with this secondary transfer field. Through these processes, the user acquires the image without imperfections of the image quality, or the image that the user prefers. And, the setting of the secondary transfer field covers the variable range of the secondary transfer field so as to include the secondary transfer conditions in the normal state, which attains satisfactory conditions of the secondary transfer field more easily. Further, the setting is made such that the user is able to designate the magnitude of variable range of the secondary transfer field; therefore, a fine adjustment after a rough adjustment is made possible, which makes it possible to obtain satisfactory conditions of the secondary transfer field still more easily.

In this description, the secondary transfer field is increased gradually from the sheets P1 toward P10, which is not limited to this, and it may be decreased gradually. In this description, the user is made to input the page number where the image quality is evaluated as the best in the secondary transfer evaluation input field 122*c*, which is not limited to this. For example, it may be arranged to make the image reader 2 read and automatically recognize the sheet P of the best image quality. In this case, to output the read result having the page number read in into the test pattern will still more facilitate the automatic recognition.

On the other hand, the image quality setting operations of the secondary transfer field Side2 involve the same processes. In this case, the secondary transfer test chart C2T is formed on both the sides of the sheets P1 through P10.

Next, the image quality setting through adjustment of the primary transfer field will be described with a concrete example. When a user sets the primary transfer field, the user also touches the parameter setting tab 102 on the setting screen S shown in FIG. 5. Accordingly, Step S110 determines that the user has selected the parameter setting selection tab 102, and Step S102 displays the parameter setting screen Sp for the setting screen S as shown in FIG. 5.

Next, if the user touches the radio button 111*a* inside the setting parameter selection area 111 of the parameter setting screen Sp, it will select the primary transfer field as the control parameter to be accepted at Step S103. If the user touches the selection button 112*b* inside the tray number selection area 112, it will select the tray to be accepted at Step S104. As the tray is selected, the selected tray number is displayed on the tray display area 112*a*. Next, the sheet information of the sheet P contained in the selected tray is displayed at in the sheet information display area 113 Step S105. The 'dedicated chart' of the default value is displayed on the chart display area 114*a* inside the use chart selection area 114, and '5' (sheets) of the default value is displayed on the dummy sheet number display area 115*a* inside the dummy sheet number selection area 115.

Next, at Step S106, the strength of the primary transfer field determined from the sheet type is displayed on the primary transfer bias input field 121*a* inside the primary transfer field setting area 121 as the default value of the detailed information; and the adjustment range is displayed on the primary transfer adjustment range setting unit 121*b*. At the time when the primary transfer field is designated at Step S103, the primary transfer field setting area 121 of the detailed condition selection area 120 is displayed with shadows (becomes active), which shows the area being capable of accepting the operation by the user.

Next, if the user touches the parameter setting screen Sp, or operates the keyboard 56*a* (see FIG. 1), it will make possible of accepting the modification of the detailed information at Step S107. And in this example, since the image quality setting operations are carried out from the default value without modifications, the default value of the detailed information is stored at Step S109. On the other hand, if there is a modification, the modified values of the detailed information are stored at Step S108. And in the same manner as the setting of the secondary transfer field, in addition to the detailed information, the type of the test charts to be used (dedicated chart, user specified chart) and the number of the dummy sheets can be modified, however this example uses the default value as it is.

And, if the user touches the execute button 131 on the parameter setting screen Sp, it will be determined as the execute instruction at Step S110, which follows fetching the control parameter group at Step S111, calculating the medium value at Step S112, and calculating the parameters of the phases each at Step S113. This processing will not be explained in detail, but it is substantially the same as that in the secondary transfer field.

Figure 10:
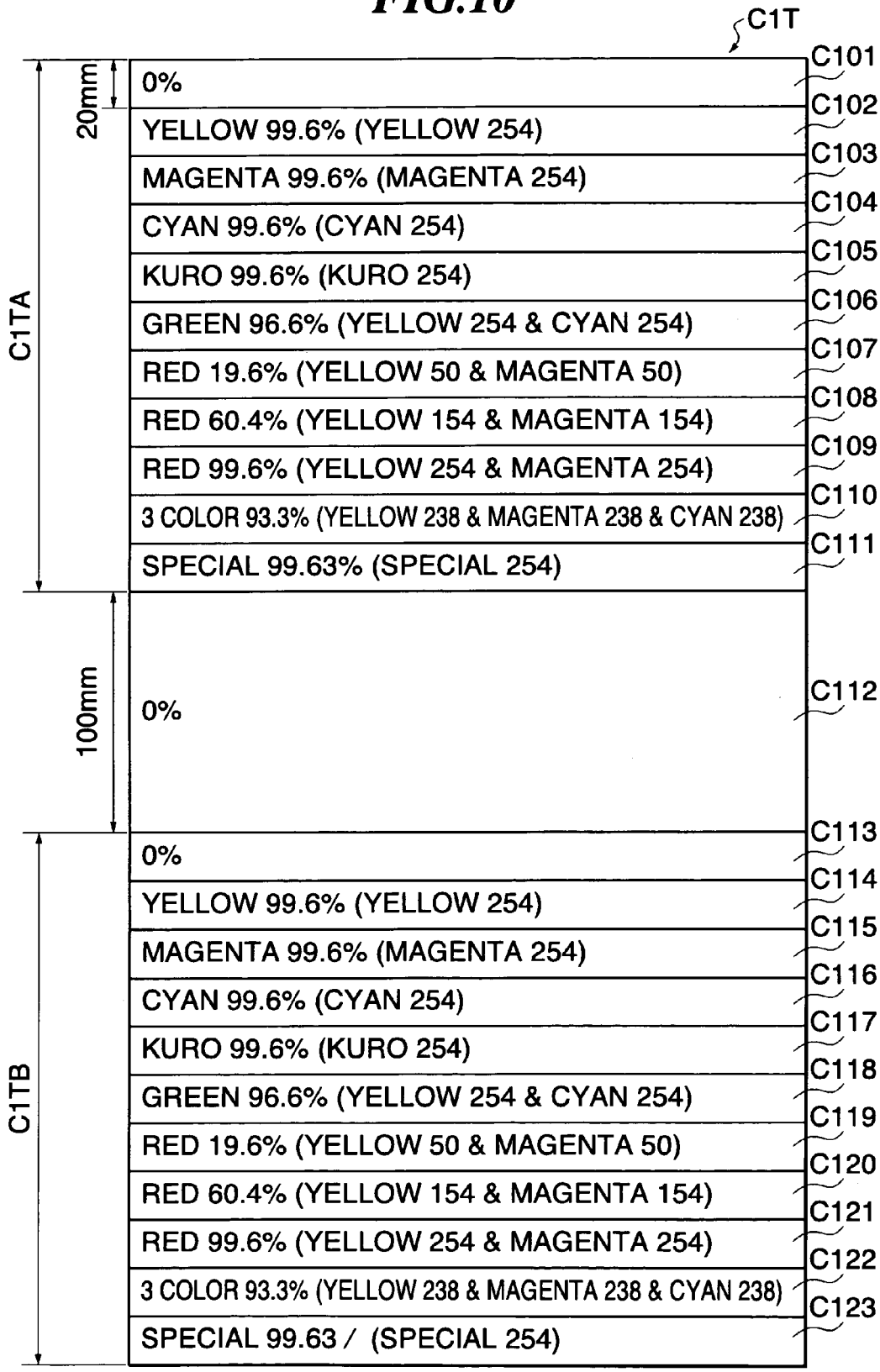
FIG. 10 is a chart to explain a primary transfer test chart.

And, Step S114 prints the test chart as follows. Now, FIG. 10 gives a primary transfer test chart C1T used for the dedicated chart for setting the primary transfer field. In the primary transfer test chart C1T, the upper part of the drawing corresponds to the upstream side. The tet chart C1T possesses the following regions from the upper to the downward: an achromatic color region (non-image formation area) C101, a yellow region C102, a magenta region C103, a cyan region C104, a black region C105, a green region C106, a light red region C107, a medium red region C108, a dark red region C109, a dark processed black region (YMC three colors mixed) C110, a special color region C111, an achromatic color region (non-image formation area) C112; and after this achromatic color region C112, the test chart C1T possesses color regions C113 to C123 in the same order. That is, a first are C1Ta on the upstream side and a second area C1Tb on the downstream side share the same color pattern with the achromatic color region C112 intervening in-between. In this embodiment, the length in the conveyance direction of the regions C101 to C111 and that of the regions C113 to C123 are both 20 mm, and the length in the conveyance direction of the region C112 is 100 mm. Also in the primary transfer test chart C1T, the toner images are to be formed along the direction orthogonal to the sheet conveyance direction (width direction of the sheet P), accordingly the toner images, are formed to the side edge part of the sheet P.

The image quality setting operations of the primary transfer field are carried out substantially in the same manner as those of the secondary transfer field, and five sheets of the dummy sheet P are conveyed and discharged. Next, in each of the image formation units 10, the primary transfer test chart C1T is formed within the interval between the time that the last dummy sheet P passes through the secondary transfer unit 20 (see FIG. 2) and the time that the first sheet P charges into the secondary transfer unit 20. However, in regard to the first area C1Ta of the primary transfer test chart C1T, the primary transfer to the intermediate transfer belt 15 is carried out in a state that the lowest primary transfer bias (Z=50%) is applied; and in regard to the second area C1Tb, the primary transfer to the intermediate transfer belt 15 is carried out in a state that the next lowest secondary transfer bias (Z=60%) is applied. The primary transfer test chart C1T formed under the different primary conditions is secondarily transferred to the sheet P under a constant secondary transfer condition, is fixed by the fixing unit 46, and is discharged into the discharge tray 57. Thereafter, the primary transfer bias is sequentially raised by 10% between the primary test charts C1T and between the first area C1Ta and the second area C1Tb inside the primary transfer test chart C1T, and the same primary transfer test chart C1T is printed to the other sheet P (2nd to 5th). After the primary transfer to the last sheet P (5th) is completed, the primary transfer bias is turned OFF to terminate a series of operations. Thus, the series of operations attain five sheets of the sheet P, on each of which the primary transfer test chart C1T with the different primary transfer condition is printed. Especially in this case, since the test chart formed on one sheet P with the two types of primary transfer conditions can be made, it is possible to save the number of the sheet P in the image quality setting operations.

Next, the user checks by viewing five sheets of the sheet P having the primary transfer test chart C1T printed, and determines the best one or the most preferable one of the image quality. In this case, the images of the same density are formed over the whole areas of the five sheet P in the direction orthogonal to the conveyance direction (for example, the regions C101 to C111). Accordingly, it is possible to easily detect both the imperfections of image quality likely to be created on the center in the conveyance direction of the sheet P, and the imperfections of image quality likely to be created on the side edges in the conveyance direction. Also, the imperfections of image quality to be created only on very limited parts can easily be detected. On the sheet P are formed the images of monochrome (for example, C102 to C105 and C111) and the images of plural colors (for example, C106 to C110). Therefore, it is possible to confirm by viewing at the same time the imperfections of image quality (for example, decrease of density) likely to be created in the case of monochrome and the imperfections of image quality (for example, retransfer) likely to be created in the case of plural colors. Further, since the high-density image and the low-density image of the same color system are formed on the sheet P (for example, the regions C107 to C109), it is possible to view the imperfections of image quality to be created depending on the density of image (for example, decrease of density in the case of low density, mottle and imperfections of fixing in the case of high density). After viewing the image quality as above, the user inputs the number of the image (not the page number) into the primary transfer evaluation input field 121*c*.

And, if the user touches the save button 134, Step S115 will accept it as the save instruction of the control parameters. Then, a pop-up window (not illustrated) for designating the name of the file to be saved is displayed in the setting screen S. After the user selects to or not to overwrite the setting file at Step S116, Step S117 saves to overwrite the file, or Step S118 saves to name the file. The saved setting file is used on forming the images on the next occasion with this sheet P (contained in the sheet tray 50 (tray number 1) in this example).

After the user determined the primary transfer field through such image quality setting operations, the image formation is performed with this primary transfer field. Thereby, the user acquires the image without imperfections of the image quality, or the image that the user prefers.

Here in this description, the image is formed on one sheet P with two types of primary transfer conditions. However, naturally the image may be formed on one sheet P with one type of primary transfer condition.

Next, the image quality setting through adjustment of the fixing temperature will be described with a concrete example. When a user sets the fixing temperature, the user also touches the parameter setting tab 102 on the setting screen S shown in FIG. 5. Accordingly, Step S101 determines that the user has selected the parameter setting selection tab 102, and Step S102 displays the parameter setting screen Sp for the setting screen S as shown in FIG. 5.

Next, if the user touches the radio button 111*d* inside the setting parameter selection area 111 of the parameter setting screen Sp, it will select the fixing temperature as the control parameter to be accepted at Step S103. And, if the user touches the selection button 112*b* inside the tray number selection area 112, it will select the tray to be accepted at Step S104. As the tray is selected, the selected tray number is displayed on the tray display area 112*a*. Next, the sheet information of the sheet P contained in the selected tray is displayed in the sheet information display area 113 at Step S105. The 'dedicated chart' of the default value is displayed on the chart display area 114*a* inside the use chart selection area 114, and '5' (sheets) of the default value is displayed on the dummy sheet number display area 115*a* inside the dummy sheet number selection area 115.

Next at Step S106, the fixing temperature (for example, 170° C.) determined from the sheet type is displayed on the fixing temperature input field 123*a* inside the fixing temperature setting area 123 as the default value of the detailed information; and the adjustment range is displayed on the fixing temperature adjustment range setting unit 123*b*. At the time when the fixing temperature is designated at Step S103, the fixing temperature setting area 123 of the detailed condition selection area 120 is displayed with shadows (becomes active), which shows the area being capable of accepting the operation by the user.

Next, if the user touches the parameter setting screen Sp, or operates the keyboard 56*a* (see FIG. 1), it will make possible of accepting the modification of the detailed information at Step S107. And in this example, since the image quality setting operations are carried out from the default value without modifications, the default value of the detailed information is stored at Step S109. On the other hand, if there is a modification, the modified values of the detailed information are stored at Step S108. And in the same manner as the setting of the secondary transfer field, in addition to the detailed information, the type of the test charts to be used (dedicated chart, user specified chart) and the number of the dummy sheets can be modified, however this example uses the default value as it is.

If the user touches the execute button 131 on the parameter setting screen Sp, it will be determined as the execute instruction at Step S110, which follows fetching the control parameter group at Step S111, calculating the medium value at Step S112, and calculating the parameters of the phases each at Step S113. This processing will not be explained in detail, but it is substantially the same as that in the secondary transfer field. However, in the setting of the fixing temperature, the conditions of the fixing temperature are to be calculated to divide into: three phases of ±10° C. with 170° C. at the center (160 to 180° C.), in the case the maximum value is designated in the fixing temperature adjustment range setting unit 123*b*; three phases of ±7° C. with 170° C. at the center (163 to 177° C.), in the case the medium value is designated; and three phases of ±3° C. with 170° C. at the center (167 to 173° C.), in the case the minimum value is designated.

Figure 11:
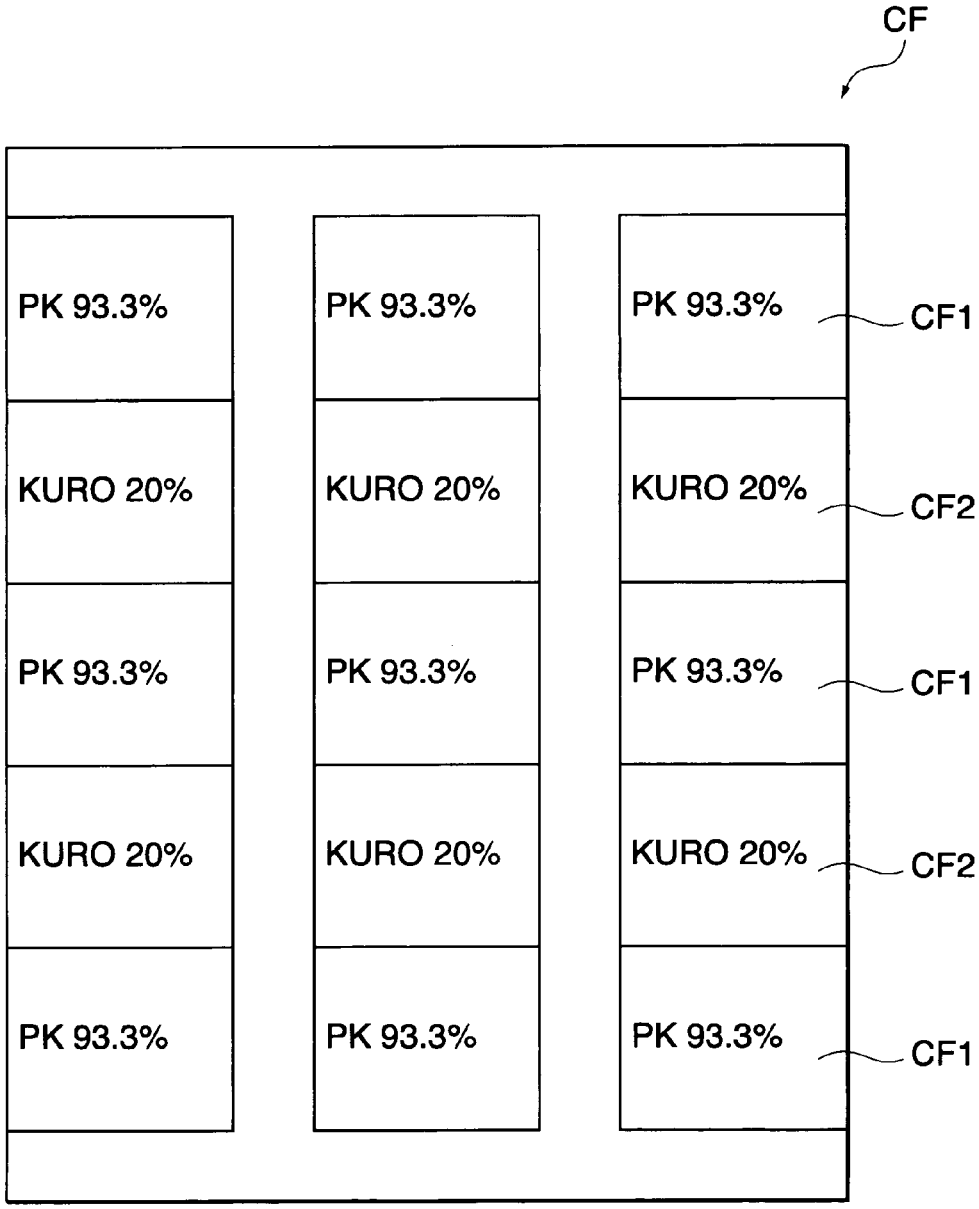
FIG. 11 is a chart to explain a fixing test chart.

Step S114 prints the test chart as follows. FIG. 11 gives a fixing test chart CF used for the dedicated chart for setting the fixing condition. In the primary transfer test chart CF, the upper part of the drawing corresponds to the upstream side. The test chart CF possesses alternately from the upper to the downward a dark processed black region (YMC three colors mixed) CF1 and a light black region CF2. The regions CF1 and CF2 are each divided into three in the direction orthogonal to the sheet conveyance direction.

In the image quality setting operations of the fixing temperature, first the fixing temperature is set to the lowest setting temperature. In the same manner as the image quality setting operations of the secondary transfer field, five of the dummy sheet P are conveyed and discharged. Next, the fixing test chart CF is fixed by the fixing unit 46, which has experienced the image formation formed by the image formation units 10, the primary transfer made onto the intermediate transfer belt 15, and the secondary transfer made onto the sheet P; and the fixing test chart CF is discharged into the discharge tray 57. When the first sheet P having the fixing test chart CF printed thereon is discharged, the temperature rise is started toward the next setting temperature (+10° C.). And, when the temperature rise toward the next setting temperature is completed, again five of the dummy sheets P are conveyed and discharged, and the next sheet P having the fixing test chart CF printed thereon is discharged. Thereafter, the increase of the temperature and the printing of the test chart are repeated to form three sheets of printing, and there a series of operations are terminated.

Next, the user checks by viewing three of the sheets P having the fixing test chart CF printed thereon, and determines the best one or the most preferable one of the image quality. After viewing the image quality as above, the user inputs the page number into the fixing temperature evaluation input field 123*c*.

And, if the user touches the save button 134, Step S115 will accept it as the save instruction of the control parameters. Then, a pop-up window (not illustrated) for designating the name of the file to be saved is displayed in the setting screen S. After the user selects to or not to overwrite the setting file at Step S116, Step S117 saves to overwrite the file, or Step S118 saves to name the file. The saved setting file is used for forming the images on the next occasion with this sheet P (contained in the sheet tray 50 (tray number 1) in this example).

After the user determined the fixing temperature through such image quality setting operations, the image formation is performed with this fixing temperature. Thereby, the user acquires the image without imperfections of the image quality, or the image that the user prefers.

On the other hand, in the case of adjusting the fixing speed, substantially in the same manner as the case with the above adjustment of the fixing temperature, the setting of the fixing speed is carried out. However in this case, the temperature speed should be constant; accordingly to wait for a temperature rise is not necessary, and a sequential printout of the test chart is possible.

In this embodiment, when performing the setting of the secondary transfer field, primary transfer field, fixing temperature, and fixing speed, each of the setting is evaluated by means of the dedicated chart, which is not limited to this. For example, the primary transfer test chart may be used for setting the secondary transfer field. It is also possible to use a user specified image (for example, the image itself then being formed) as the test chart, instead of the dedicated chart. It may be advisable to automatically discriminate a test chart by an image recognition part and calculate an optimum image quality condition by means of a control program.

The entire disclosure of Japanese Patent Application No. 2003-074940 filed on Mar. 19, 2003 including specification, claims, drawings and abstract is incorporated herein by reference in its entirety.

What is claimed is:

1. An image formation system comprising:

an image formation condition setting part that sets a plurality of image formation conditions within a predetermined range;

an image formation part that forms images on recording materials on the basis of the plurality of image formation conditions set by the image formation condition setting part; and a selection part that selects a predetermined image formation condition, on the basis of images formed on the recording materials by the image formation part on the basis of different image formation conditions among the plurality of image formation conditions, wherein the image formation part includes a primary transfer mechanism that primarily transfers a toner image formed on an image holding member onto an intermediate transfer member, and a secondary transfer mechanism that secondarily transfers the toner image transferred onto the intermediate transfer member, onto the recording material; and the image formation condition setting part sets a plurality of transfer conditions in the primary transfer mechanism or the secondary transfer mechanism as the plurality of image formation conditions.

2. The image formation system according to claim 1, further comprising a setting range designation part that designates a setting range of the plurality of image formation conditions set by the image formation condition setting part.

3. The image formation system according to claim 1, further comprising a basic condition determining part that determines a basic condition of the plurality of image formation conditions on the basis of characteristics of the recording material, wherein the image formation condition setting part sets the plurality of image formation conditions to include the basic condition determined by the basic condition determining part.

4. The image formation system according to claim 1, wherein the selection part possesses an acceptance unit that accepts a selection instruction from a user.

5. An image formation system comprising:

an image forming part including a primary transfer mechanism and a secondary transfer mechanism, the image forming part forms images on recording materials; and a control parameter modification part that modifies a control parameter used in an image forming process of the image forming part, wherein each time the control parameter modification part modifies the control parameter, the image forming part sequentially forms test images on the recording materials on the basis of the modified control parameter.

6. The image formation system according to claim 5, wherein the control parameter modification part modifies the control parameter step by step.

7. The image formation system according to claim 5, further comprising an image selection part that selects a type of the test image.

8. An image formation system comprising:

an image forming part that forms images on recording materials; and a control parameter modification part that modifies a control parameter used in an image forming process of the image forming part, wherein each time the control parameter modification part modifies the control parameter, the image forming part sequentially forms test images on the recording materials on the basis of the modified control parameter, and wherein the image forming part includes a fixing member that heats and presses the image formed on the recording material to fix them, and passes a dummy recording material through the fixing member before forming the test images on the recording materials.

9. The An image formation system comprising:

an image forming part that forms images on recording materials; and a control parameter modification part that modifies a control parameter used in an image forming process of the image forming part, wherein each time the control parameter modification part modifies the control parameter, the image forming part sequentially forms test images on the recording materials on the basis of the modified control parameter, and wherein the image forming part includes a fixing member that heats and presses the images formed on the recording material to fix them, and sequentially forms the test images from the lowest setting temperature of fixing temperature.

10. The image formation system according to claim 5, wherein the control parameter modification part modifies the control parameter between the recording material and the next recording material, and/or inside a non-image formation area of the test image.

11. An image formation system comprising:

an image formation condition setting part that sets a plurality of image formation conditions;

a test chart output part that outputs test charts on recording materials on the basis of the plurality of image formation conditions set by the image formation condition setting part; and an image formation part including a primary transfer mechanism and a secondary transfer mechanism, the image formation part forms an image under a specific image formation condition selected among the plurality of image formation conditions set by the image formation condition setting part.

12. The image formation system according to claim 11, wherein the image formation condition setting part sets a plurality of transfer fields and/or a plurality of fixing temperatures.

13. The image formation system according to claim 11, wherein a setting range of the plurality of image formation conditions that can be set by the image formation condition setting part is variable.

14. A method of determining an image formation condition for forming images on recording materials, comprising:

setting a plurality of image formation conditions;

sequentially forming a plurality of images from a primary transfer mechanism and a secondary transfer mechanism on recording materials on the basis of the plurality of image formation conditions set; and selecting a final image formation condition on the basis of the plurality of images formed on the recording materials on the basis of different image formation conditions among the plurality of image formation conditions.

15. The method of determining an image formation condition according to claim 14, wherein a basic image formation condition is selected on the basis of a type of the recording material, and the plurality of image formation conditions are set to include the basic image formation condition.

16. The method of determining an image formation condition according to claim 14, wherein, before setting the plurality of image formation conditions, a selection range is set for the plurality of image formation conditions.

17. A storage medium readable by a computer, the storage medium storing a program of instructions executable by the computer to perform a function for determining an image formation condition, the function comprising the steps of:

setting a plurality of image formation conditions;

sequentially forming images from a primary transfer mechanism and a secondary transfer mechanism on recording materials on the basis of the plurality of image formation conditions; and selecting a final image formation condition on the basis of images formed on the recording materials on the basis of different image formation conditions among the plurality of image formation conditions.

* * * * *